US009410327B2

(12) United States Patent
Engstrom

(10) Patent No.: US 9,410,327 B2
(45) Date of Patent: Aug. 9, 2016

(54) JOINT GUARD FOR PANELS

(71) Applicant: PERGO (EUROPE) AB, Trelleborg (SE)

(72) Inventor: Nils-Erik Engstrom, Trelleborg (SE)

(73) Assignee: PERGO (EUROPE) AB, Trelleborg (SE)

( * ) Notice: Subject to any disclaimer, the term of this patent is extended or adjusted under 35 U.S.C. 154(b) by 0 days.

(21) Appl. No.: 14/456,755

(22) Filed: Aug. 11, 2014

(65) Prior Publication Data

US 2015/0075105 A1 Mar. 19, 2015

Related U.S. Application Data

(63) Continuation of application No. 12/278,274, filed as application No. PCT/SE2007/000070 on Jan. 26, 2007, now abandoned.

(30) Foreign Application Priority Data

Feb. 3, 2006 (SE) ..... 0600227

(51) Int. Cl.

| | |
|---|---|
| ***E04F 21/00*** | (2006.01) |
| ***E04F 15/02*** | (2006.01) |
| ***E04F 21/22*** | (2006.01) |
| ***E04B 1/61*** | (2006.01) |
| *E04F 15/04* | (2006.01) |

(52) U.S. Cl.

CPC ..... *E04F 15/02038* (2013.01); *E04B 1/54* (2013.01); *E04F 15/02* (2013.01); *E04F 15/02022* (2013.01); *E04F 21/22* (2013.01); *E04F 15/04* (2013.01); *E04F 2201/0115* (2013.01); *E04F 2201/0138* (2013.01); *E04F 2201/0153* (2013.01); *E04F 2201/0523* (2013.01)

(58) Field of Classification Search

CPC ..... E04F 15/02; E04F 15/02038; E04F 15/02022; E04F 2201/0138; E04F 2201/0588

See application file for complete search history.

(56) References Cited

U.S. PATENT DOCUMENTS

| | | | | |
|---|---|---|---|---|
| 847,272 A | | 3/1907 | Ayers | |
| 1,000,859 A | * | 8/1911 | Vaughan | 81/46 |
| 1,002,102 A | * | 8/1911 | Weedon | 81/44 |

(Continued)

FOREIGN PATENT DOCUMENTS

| | | |
|---|---|---|
| WO | WO 94/26999 A1 | 11/1994 |
| WO | WO 97/47834 A1 | 12/1997 |

(Continued)

OTHER PUBLICATIONS

International Search Report for Application No. PCT/SE2007/000070 dated Mar. 3, 2007.

(Continued)

*Primary Examiner* — Elizabeth A Quast

(74) *Attorney, Agent, or Firm* — Jenkins, Wilson, Taylor & Hunt, P.A.

(57) ABSTRACT

A joint guard provided for protecting, and stabilizing portions in the edge region of a panel, the portions being selected from the group consisting of a distal edge, a downwards protruding heel, a upper joint edge, a groove, a lower cheek, a distal end, an upwards protruding lower cheek heel, an upper joining edge, an undercut, a moveable locking element, a locking tongue, a locking tongue leg and a maneuvering leg.

16 Claims, 16 Drawing Sheets

(56) References Cited

U.S. PATENT DOCUMENTS

| | | | | |
|---|---|---|---|---|
| 1,266,253 | A * | 5/1918 | Hakanson | 254/11 |
| 3,572,224 | A * | 3/1971 | Perry | 404/40 |
| 3,720,027 | A * | 3/1973 | Christensen | 52/309.8 |
| 4,683,631 | A | 8/1987 | Dobbertin | |
| 4,998,396 | A | 3/1991 | Palmersten | |
| 5,138,812 | A | 8/1992 | Palmersten | |
| 5,148,850 | A * | 9/1992 | Urbanick | 160/231.1 |
| 5,165,816 | A | 11/1992 | Parasin | |
| 5,274,979 | A * | 1/1994 | Tsai | 52/588.1 |
| 5,343,665 | A | 9/1994 | Palmersten | |
| 5,765,808 | A | 6/1998 | Butschbacher et al. | |
| 5,931,447 | A | 8/1999 | Butschbacher et al. | |
| 5,971,655 | A * | 10/1999 | Shirakawa | 404/40 |
| 6,079,182 | A | 6/2000 | Ellenberger | |
| 6,233,899 | B1 * | 5/2001 | Mellert et al. | 52/747.1 |
| 6,363,677 | B1 * | 4/2002 | Chen et al. | 52/586.1 |
| 6,423,257 | B1 | 7/2002 | Stobart et al. | |
| 6,647,690 | B1 * | 11/2003 | Martensson | 52/601 |
| 6,763,643 | B1 * | 7/2004 | Mårtensson | 52/586.1 |
| 6,769,835 | B2 * | 8/2004 | Stridsman | 404/41 |
| 6,854,235 | B2 * | 2/2005 | Martensson | 52/601 |
| 2004/0016197 | A1 | 1/2004 | Ruhdorfer | |
| 2004/0182036 | A1 | 9/2004 | Sjoberg et al. | |
| 2004/0211143 | A1 * | 10/2004 | Hanning | 52/578 |
| 2007/0028547 | A1 * | 2/2007 | Grafenauer et al. | 52/586.1 |
| 2009/0217615 | A1 | 9/2009 | Engstrom | |

FOREIGN PATENT DOCUMENTS

| | | | |
|---|---|---|---|
| WO | WO 00/47841 | A1 | 8/2000 |
| WO | WO 03/083234 | A1 | 10/2003 |
| WO | WO 2005/040521 | A2 | 5/2005 |
| WO | WO 2005/054599 | A1 | 6/2005 |
| WO | WO 2007/089186 | A1 | 8/2007 |

OTHER PUBLICATIONS

Non-Final Office Action for U.S. Appl. No. 12/278,274 dated Sep. 24, 2009.

Final Office Action for U.S. Appl. No. 12/278,274 dated May 17, 2010.

Advisory Action for U.S. Appl. No. 12/278,274 dated Sep. 27, 2010.

Non-Final Office Action for U.S. Appl. No. 12/278,274 dated Nov. 2, 2010.

Final Office Action for U.S. Appl. No. 12/278,274 dated Apr. 14, 2011.

* cited by examiner

JOINT GUARD FOR PANELS

CROSS-REFERENCE TO RELATED APPLICATIONS

This application is a continuation of and claims priority to U.S. patent application Ser. No. 12/278,274 filed Dec. 17, 2008, which claims priority to PCT/SE07/00070 filed Jan. 26, 2007, which claims priority to Swedish Application No. 0600227-3 filed on Feb. 3, 2006, the entire disclosures of which are incorporated herein by reference.

TECHNICAL FIELD

The present disclosure relates to a joint guard used when cutting panels.

BACKGROUND

Prefabricated floor boards provided with tongue and groove at the edges are quite common nowadays. These can be installed by the average handy man as they are very easy to install. Such floors can, for example, be constituted of solid wood, fiber board or particle board. These are most often provided with a surface layer such as lacquer, or some kind of laminate. The boards are most often installed by being glued via tongue and groove. The most common types of tongue and groove are however burdened with the disadvantage of forming gaps of varying width between the floor boards in cases where the installer has not been thorough. Dirt will easily collect in such gaps. Moisture will furthermore enter the gaps which will cause the core to expand in cases where it is made of wood, fiber board or particle board, which usually is the case. The expansion will cause the surface layer to rise closest to the edges of the joint which radically reduces the useful life of the floor since the surface layer will be exposed to exceptional wear. Different types of tensioning devices forcing the floor boards together during installation can be used to avoid such gaps. This operation is however more or less awkward. It is therefore desirable to achieve a joint which is self-guiding and thereby automatically finds the correct position. Such a joint would also be possible to utilize in floors where no glue is to be used.

Different types of joints with mechanical locking have been made available. One such joint is known through WO 94/26999. Here a lower lip is present in the form a thin strip which in selected embodiments is made of thin, aluminum sheets. This is a delicate part which is easily damaged when cutting the panel in connection to the assembly. The same problem applies to some extent on embodiments known through WO 97/47834. The locking parts of these types of floor panels are delicate and easily damaged but once properly installed are still very strong. It is an object of the present disclosure to solve the problem connected to the cutting and assembly of these and similar type of floor panels being provided with delicate locking parts.

SUMMARY

It has through the present disclosure been made possible to protect the delicate edges of panels provided with locking members. Accordingly, the present disclosure relates to a joint guard intended to be used in connection with the installation of floor panels. The present disclosure is characterized in that the joint guard is provided with means for protecting and stabilizing portions of the edge region of a panel. These portions are selected from the group consisting of: a distal edge, a downwards protruding heel, an upper joint edge, a groove, a lower cheek, a distal end, an upwards protruding lower cheek heel, an upper joining edge, an undercut, a moveable locking element, a locking tongue, a locking tongue leg, a maneuvering leg and a face section.

According to one embodiment the joint guard is provided with a locking tongue stopper. The locking tongue stopper is intended to ensure that the moveable locking element is kept in a default position during the milling as well as keeping it from getting caught in the teeth of the saw during the cutting operation.

According to one embodiment the joint guard is provided with a locking tongue leg support and a maneuvering leg support. The locking tongue leg support and maneuvering leg support is intended to ensure that the moveable locking element and maneuvering leg is kept in a default position during the milling as well as keeping it from getting caught in the teeth of the saw during the cutting operation.

According to one embodiment the joint guard is provided with a locking tongue leg support and a face section support. The locking tongue leg support and a face section support is intended to ensure that the locking tongue leg and a face section is kept from getting caught in the teeth of the saw and thereby deformed during the cutting operation.

It is possible to make the joint guard from a multitude of different materials such as a thermoplastic material, a metal, a thermosetting material, wood, wood fiber and wood particles.

The disclosure also relates to a joint guard provided with means for protecting and stabilizing portions in the edge region of a panel. The portions are selected from the group consisting of: a tongue, a rear groove, a lower cheek, a distal end, an inner locking groove, a tongue groove, a locking member surface, a moveable locking member, an inner locking tongue, a maneuvering cheek and an outer locking tongue.

According to one embodiment the joint guard is provided with a maneuvering cheek support. The maneuvering cheek support is intended to ensure that the moveable locking element is kept in a default position during the milling as well as keeping it from getting caught in the teeth of the saw during the cutting operation.

According to one embodiment the joint guard is provided with an outer locking tongue support. The outer locking tongue support is intended to ensure that the moveable locking element is kept in a default position during the milling as well as keeping it from getting caught in the teeth of the saw and deformed during the cutting operation.

As is understood by the accompanying drawings the moveable locking element may be applied on either the groove portion, or the tongue portion of a joint. In order to ensure a correct positioning of the joint guard on the groove portion provided with a moveable locking element, it is advantageous to provide a joint guard with a groove engaging tongue. In cases where the moveable locking element is arranged on the tongue portion, the joint guard is suitably provided with a tongue engaging groove for ensuring a correct positioning.

It is possible to make the joint guard from a multitude of different materials such as a thermoplastic material, a metal, a thermosetting material, wood, wood fiber and wood particles.

The joint guard according to the present disclosure is primarily used during cutting of panels and is then applied to the edge very much like another panel would be. The biggest difference between another panel and the joint guard is that the joint guard is designed not to engage or activate the different locking mechanisms of the panel edge. As will be evident when studying enclosed embodiment examples of joints , some embodiments of joints will not be easily disassembled once two panels are joined together. The joint guard is therefore designed to hold the locking mechanism in place without activating it. The joint guard is furthermore so designed as to not cause any substantial wear or deformation on functional parts such as locking edges and the like on embodiments herein described as well as on embodiment disclosed by reference. The joint guard is then applied on the edge of the panel to be cut and the cutting may commence. The cutting is either performed through the joint guard or using the joint guard as a ruler. It is however advantageous to arrange the joint guard on the portion of the panel that is to be used in the installation. The joint guard is advantageously also used as a tapping block during the installation of floor panels.

In selected embodiments of joints the joint guard may serve as tool for returning moveable locking elements to default position in case these by accident is out of the pre-assembly position.

Floor panel joints may be designed in different ways, as for example as known through WO 94/26999, WO 97/47834 and WO 03/083234. It is also possible to provide the joint with a resilient joining member made as a separate piece which is joined with the edge of the panel. Such joints are known through WO 00/47841 and WO 2005/054599. Also herein disclosed embodiments of joints serve as examples of joints which benefit from being protected during cutting.

A joint has a first edge and a second edge. The first edge is provided with a distal edge and a downwards protruding heel. The distal edge is further provided with an upper joint edge beneath which a groove is arranged. The second edge is provided with lower cheek having a distal end at which an upwards protruding lower cheek heel is arranged. The second edge is further provided with an upper joining edge beneath which an undercut is arranged. A moveable locking element is arranged in the space created by the undercut. The moveable locking element has a locking tongue, a locking tongue leg and a maneuvering leg. The second edge is intended to join with the first edge through vertical motion. The moveable locking element, or more precisely the locking tongue of the locking element, will be displaced by the vertical motion when the two edges are moved towards each other. The displacement can be seen as a rotation where the locking tongue is brought to rotate around a selected pivot point. Resilient action may also realize this rotating action.

Suitably, the downwards protruding heel presses on the maneuvering leg, thereby urging the locking tongue to move forward and engage the groove. An upper locking surface of the locking tongue is suitably longer than the portion of the locking tongue that can engage the groove.

The lower cheek heel suitably has a front face and the downwards protruding heel has a rear face. The front face and the rear face are then preferably intended to interact, the interaction resulting in the upper joint edge and the upper joining edge being urged together in an assembled joint.

According to one alternative the lower cheek heel suitably has a front face and the downwards protruding heel has a rear face while the maneuvering leg has a face section. The front face and the rear face are then preferably intended to interact, having the face section in an intermediate position, the interaction resulting in the upper joint edge and the upper joining edge being urged together in an assembled joint.

According to one special embodiment the locking element is provided with a hinge. This will allow a snap-action cam lock effect.

A moveable locking element may suitably be made through extrusion molding and it can be made of thermoplastic material, thermosetting material or even of metal.

According to another alternative the joint have a first edge and a second edge where the first edge is provided with a tongue and a rear groove. The second edge is provided with a lower cheek having a distal end, an inner locking groove, a tongue groove and a locking member surface. The moveable locking member is arranged on the locking member surface. The moveable locking member has an inner locking tongue, a maneuvering cheek and an outer locking tongue. The second edge is intended to join with the first edge through horizontal motion.

Suitably, a maneuvering area beneath the tongue can press on the maneuvering cheek urging the inner locking tongue to move downwards and engage the inner locking groove. The maneuvering area beneath the tongue can suitably press on the maneuvering cheek also urging the outer locking tongue to move upwards and engage the rear groove.

A moveable locking element like herein described may suitably be made through extrusion molding and it can be made of thermoplastic material, thermosetting material, a composite material or even of metal.

The joint as herein described is suitably used on products such as floor panels or wall panels. According to another embodiment, a floor panel can include a core which is covered with an upper decorative surface. The core most often consists of wood particles or fiber bonded together with glue or resin. Such core boards are commonly known as Medium Density Fiber board (MDF), High Density Fiber board (HDF), Oriented Strand Board (OSB) or particle board. It is, however, also possible to utilize the embodiments on cores made of solid wood. Since wood based core materials are sensitive to moisture it may be advantageous to treat the area closest to the joint if the floor is to be exposed to moisture. This treatment may suitably include resin, wax or some kind of lacquer. It will not be necessary to treat the joint if the panels are to be glued since the glue itself will protect the joint from moisture penetration. The decorative upper surface may consist of a decorative paper possibly impregnated with melamine-formaldehyde resin. One or more layers of so called overlay paper of cellulose, impregnated with melamine-formaldehyde resin can be suitably placed on top of the decorative paper. One or more of the above layers may be sprinkled with hard particles, of for example aluminum oxide, silicon carbide or silicon oxide in connection to the impregnation in order to improve the abrasion resistance. The paper impregnated with resin is cured before, or in connection to applying it to the core. The paper layers are suitably laminated together before they are applied to the core in cases where the upper decorative surface is constituted by more than one paper layers. The lower side may suitably be coated with a lacquer or a resin impregnated paper. It is also possible to arrange an impregnated support paper between the decor and the core.

A plurality of possible upper surfaces can be applied to the core. For example, thermosetting laminates including at least a decorative paper impregnated with melamine-formaldehyde resin can be applied to the core. Overlay paper and hard particles may be added to this as described earlier in the present application. The upper decorative surface may also be constituted by an acrylic foil, an acrylic lacquer and combinations thereof. It might also be constituted by a foil or a lacquer of polyolefins or polyolefin derivatives. It is also possible to coat a decorative surface with an acrylic lacquer containing, or being sprinkled with, hard particles of $\alpha$-aluminum oxide, silicon carbide or silicon oxide. The coating is most often achieved through use of a roller or through curtain coating. Among suitable acrylic lacquers can be mentioned radiation curing ones which are cured with electron beam or ultraviolet light forming free radicals in the uncured lacquer. It is further possible to use wood veneer, most often coated with oil, wax or lacquer.

It has also shown that herein described joints are well suited for other materials as well. It is for example possible to use the joints on cores made of mineral based materials such as stone like marble, granite, slate, diabase, sandstone, limestone and the like. It is also possible to use the joints on cores made of ceramic, ceramic-like or composite materials like brick, concrete, fiber cement, glazed and non-glazed ceramic tiles. Some of these materials may be polished as the only surface treatment, while glazing, painting or oil treatment is an example of other surface treatments possible to utilize on above mentioned core materials. It is of course also possible, as described together with wood based core materials, to arrange thermosetting laminates including at least a decorative paper impregnated with melamine-formaldehyde resin. Overlay paper and hard particles may be added to this as described earlier in the present application. The upper decorative surface may also be constituted by an acrylic foil, an acrylic lacquer and combinations thereof. It might also be constituted by a foil or a lacquer of polyolefins or polyolefin derivatives.

BRIEF DESCRIPTION OF EMBODIMENT JOINT EXAMPLES

The disclosure is further described together with drawing showing different embodiments whereby, FIG. 1*a-b* shows a first embodiment of a joint 1;

FIG. 2*a-b* shows a second embodiment of a joint 1;

FIG. 3*a-b* shows a third embodiment of a joint 1;

FIG. 4*a-b* shows a fourth embodiment of a joint 1;

FIG. 5*a-b* shows a fifth embodiment of a joint 1;

FIG. 6*a-b* shows a sixth embodiment of a joint 1;

FIG. 6*c*shows an alternative version of the sixth embodiment shown in FIG. 6*a-b* of a joint 1;

FIG. 7*a-b* shows a seventh embodiment of a joint 1;

FIG. 8*a-b* shows a eighth embodiment of a joint 1;

FIG. 9 shows a ninth embodiment of a joint 1; and

FIG. 10*a-b* shows a tenth embodiment of a joint 1.

BRIEF DESCRIPTION OF PREFERRED EMBODIMENT EXAMPLES

DETAILED DESCRIPTION OF EMBODIMENT JOINT EXAMPLES

Figure 1A:
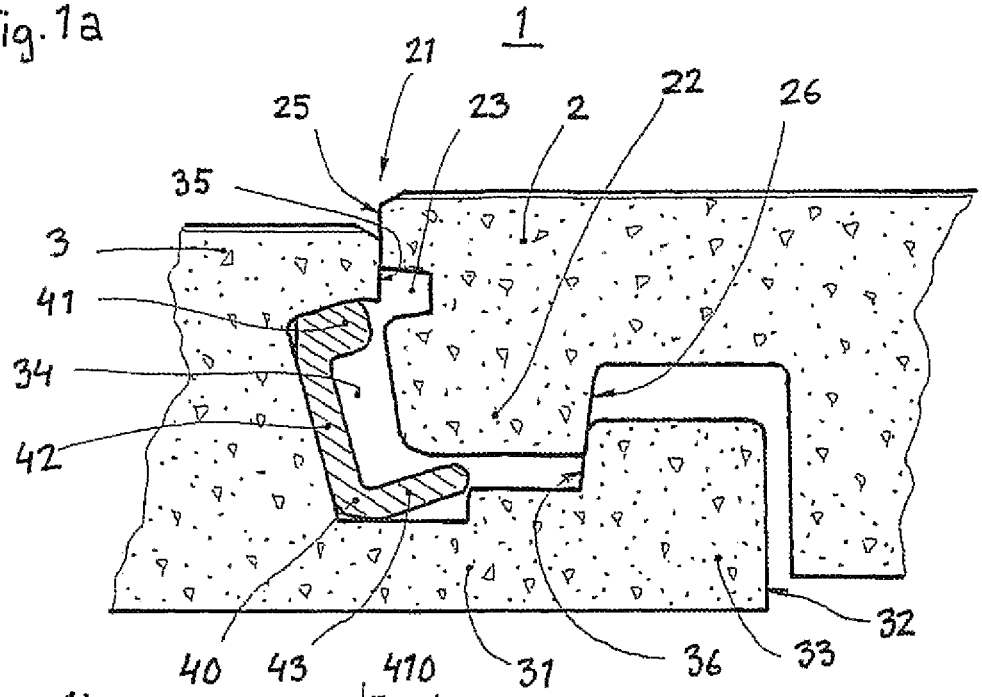
Figure 1B:
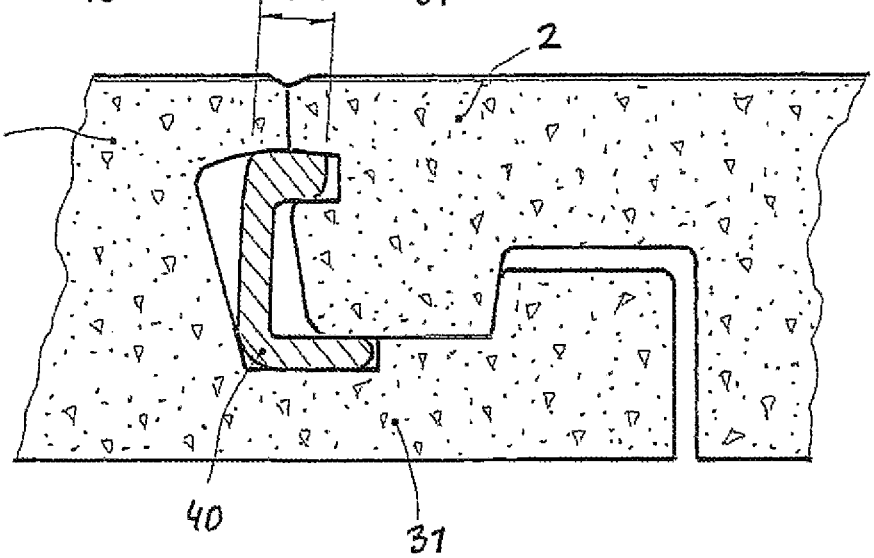

Accordingly, FIG. 1*a-b* shows in cross-section a joint 1 having a first edge 2 and a second edge 3 according to a first embodiment. FIG. 1 a shows the joint 1 just before the joining and FIG. 1*b* shows the joint 1 after assembly. The first edge 2 is provided with a distal edge 21 and a downwards protruding heel 22. The distal edge 21 is further provided with an upper joint edge 25 beneath which a groove 23 is arranged. The second edge 3 is provided with a lower cheek 31 having a distal end 32 at which an upwards protruding lower cheek heel 33 is arranged. The second edge 3 is further provided with an upper joining edge 35 beneath which an undercut 34 is arranged. A moveable locking element 40 is arranged in the space created by the undercut 34. The moveable locking element 40 has a locking tongue 41, a locking tongue leg 42 and a maneuvering leg 43. The second edge 3 is intended to join with the first edge 2 through vertical motion.

The downwards protruding heel 22 thereby presses on the maneuvering leg 43 urging the locking tongue 41 to move forward and engage the groove 23. To ensure this, an upper locking surface 410 of the locking tongue 41 is longer than the portion of the locking tongue 41 that can engage the groove 23. The lower cheek heel 33 have a front face 36 while the downwards protruding heel 22 have a rear face 26. The front face 36 and the rear face 26 are intended to interact which results in the upper joint edge 25 and the upper joining edge 35 being urged together in an assembled joint 1.

Figure 2A:
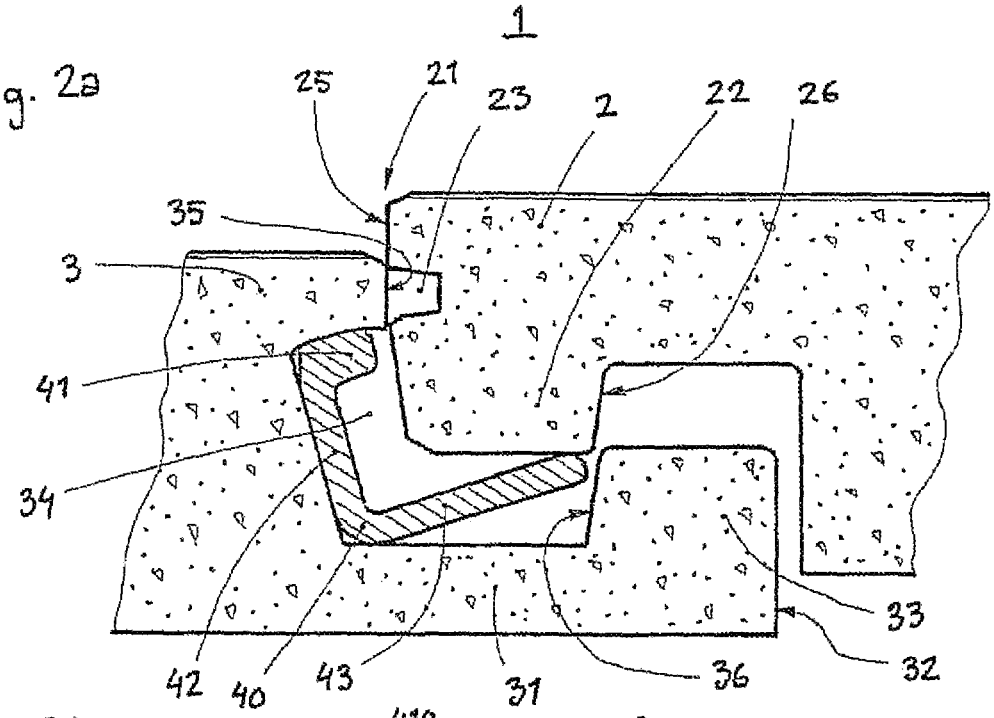
Figure 2B:
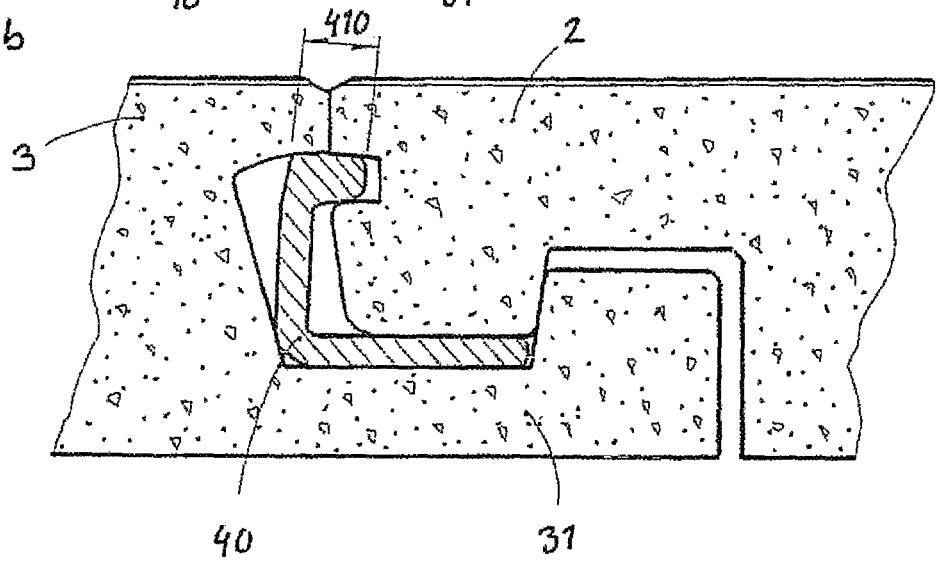

FIG. 2*a-b* shows, in cross-section, a joint 1 having a first edge 2 and a second edge 3 according to a second embodiment. FIG. 2*a* shows the joint 1 just before the joining and FIG. 2*b* shows the joint 1 after assembly. The first edge 2 is provided with a distal edge 21 and a downwards protruding heel 22. The distal edge 21 is further provided with an upper joint edge 25 beneath which a groove 23 is arranged. The second edge 3 is provided with a lower cheek 31 having a distal end 32 at which an upwards protruding lower cheek heel 33 is arranged. The second edge 3 is further provided with an upper joining edge 35 beneath which an undercut 34 is arranged. A moveable locking element 40 is arranged in the space created by the undercut 34. The moveable locking element 40 has a locking tongue 41, a locking tongue leg 42 and a maneuvering leg 43. The second edge 3 is intended to join with the first edge 2 through vertical motion. The maneuvering leg 43 is here extended to increase the locking force. The downwards protruding heel 22 hereby presses on the maneuvering leg 43 urging the locking tongue 41 to move forward and engage the groove 23. To ensure this, an upper locking surface 410 of the locking tongue 41 is longer than the portion of the locking tongue 41 that can engage the groove 23. The lower cheek heel 33 have a front face 36 while the downwards protruding heel 22 have a rear face 26. The front face 36 and the rear face 26 are intended to interact which results in the upper joint edge 25 and the upper joining edge 35 being urged together in an assembled joint 1.

Figure 3A:
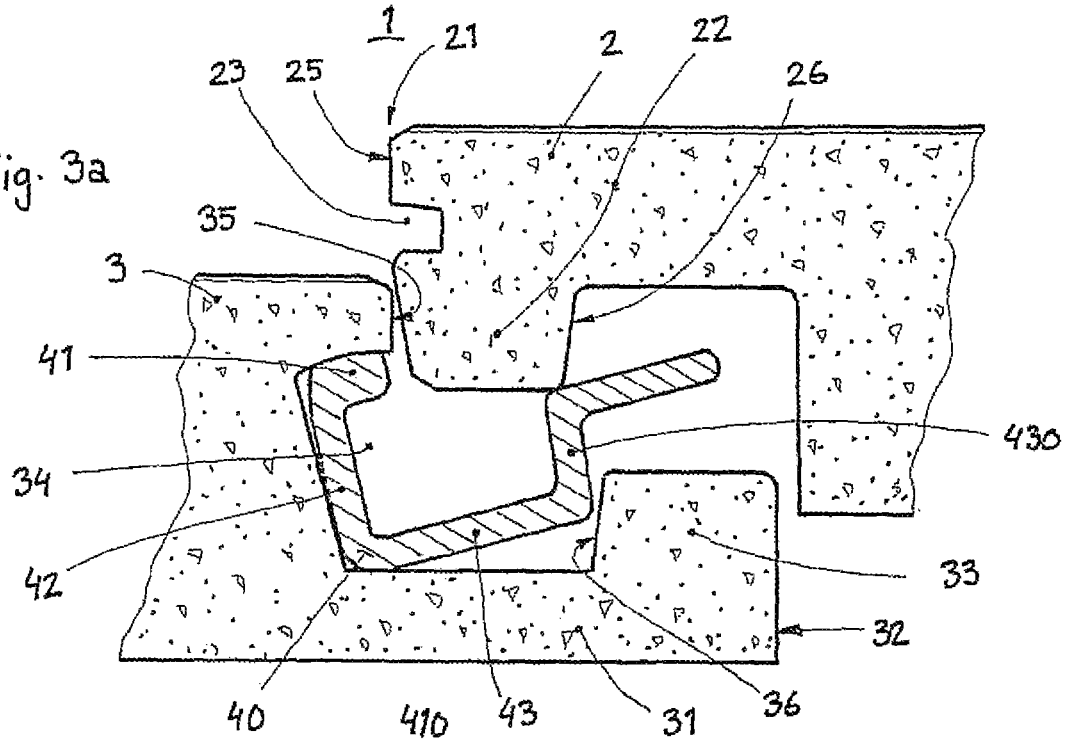
Figure 3B:
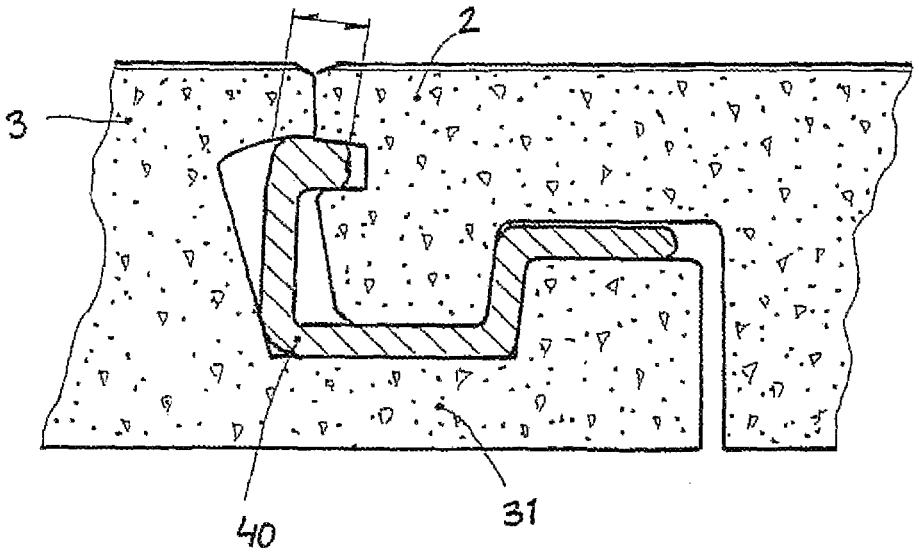

FIG. 3*a-b* shows, in cross-section, a joint 1 having a first edge 2 and a second edge 3 according to a third embodiment. FIG. 3*a* shows the joint 1 just before the joining and FIG. 3*b* shows the joint 1 after assembly. The first edge 2 is provided with a distal edge 21 and a downwards protruding heel 22. The distal edge 21 is further provided with an upper joint edge 25 beneath which a groove 23 is arranged. The second edge 3 is provided with a lower cheek 31 having a distal end 32 at which an upwards protruding lower cheek heel 33 is arranged. The second edge 3 is further provided with an upper joining edge 35 beneath which an undercut 34 is arranged. A moveable locking element 40 is arranged in the space created by the undercut 34. The moveable locking element 40 has a locking tongue 41, a locking tongue leg 42 and a maneuvering leg 43. The second edge 3 is intended to join with the first edge 2 through vertical motion. The maneuvering leg 43 is here extended further to increase the locking force. The downwards protruding heel 22 hereby presses on the maneuvering leg 43 urging the locking tongue 41 to move forward and engage the groove 23. To ensure this, an upper locking surface 410 of the locking tongue 41 is longer than the portion of the locking tongue 41 that can engage the groove 23. The lower cheek heel 33 have a front face 36 while the downwards protruding heel 22 have a rear face 26. The lower cheek heel 33 have a front face 36 while the downwards protruding heel 22 have a rear face 26 and the maneuvering leg have a face section 430. The front face 36 and the rear face 26 are intended to interact, having the face section 430 in an intermediate position. The interaction results in the upper joint edge 25 and the upper joining edge 35 being urged together in an assembled joint 1.

Figure 4A:
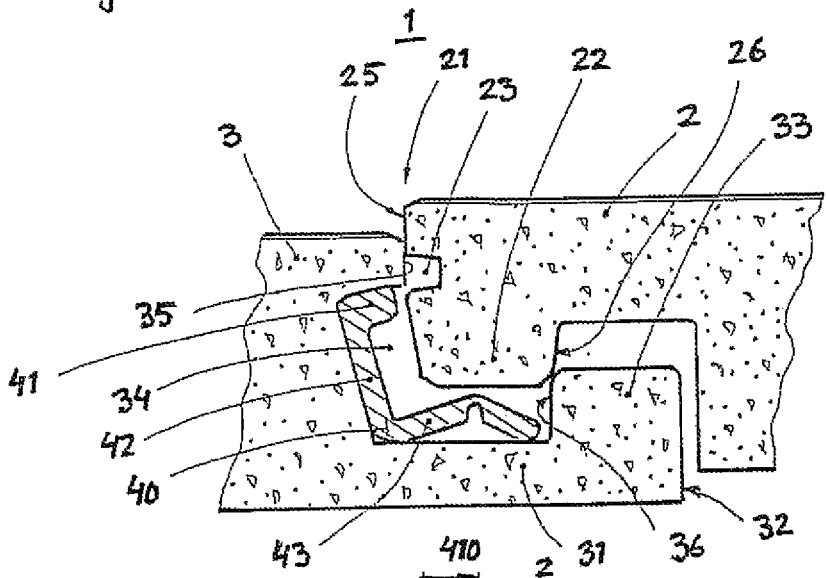
Figure 4B:
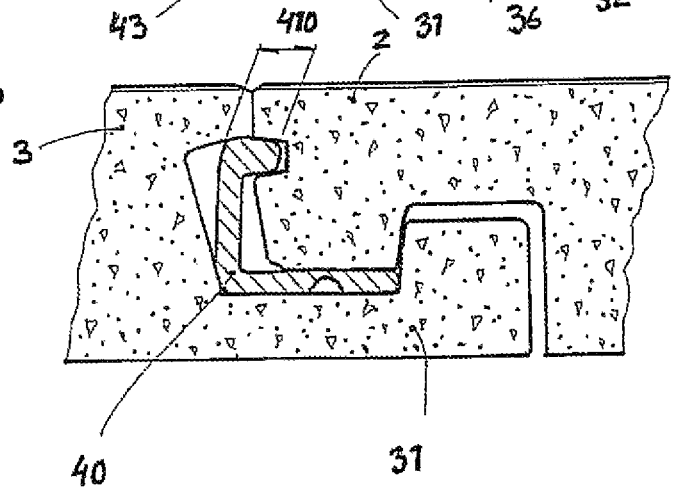

FIG. 4*a-b* shows in cross-section a joint 1 having a first edge 2 and a second edge 3 according to a fourth, embodiment. FIG. 4*a* shows the joint 1 just before the joining and FIG. 4*b* shows the joint 1 after assembly. The first edge 2 is provided with a distal edge 21 and a downwards protruding heel 22. The distal edge 21 is further provided with an upper joint edge 25 beneath which a groove 23 is arranged. The second edge 3 is provided with a lower cheek 31 having a distal end 32 at which an upwards protruding lower cheek heel 33 is arranged. The second edge 3 is further provided with an upper joining edge 35 beneath which an undercut 34 is arranged. A moveable locking element 40 is arranged in the space created by the undercut 34. The moveable locking element 40 has a locking tongue 41, a locking tongue leg 42 and a maneuvering leg 43. The second edge 3 is intended to join with the first edge 2 through vertical motion. The maneuvering leg 43 is provided with a hinge which allows a cam lock effect.

The downwards protruding heel 22 hereby presses on the maneuvering leg 43 urging the locking tongue 41 to move forward and engage the groove 23. To ensure this, an upper locking surface 430 of the locking tongue 41 is longer than the portion of the locking tongue 41 that can engage the groove 23. The lower cheek heel 33 have a front face 36 while the downwards protruding heel 22 have a rear face 26. The front face 36 and the rear face 26 are intended to interact which results in the upper joint edge 25 and the upper joining edge 35 being urged together in an assembled joint 1.

Figure 5A:
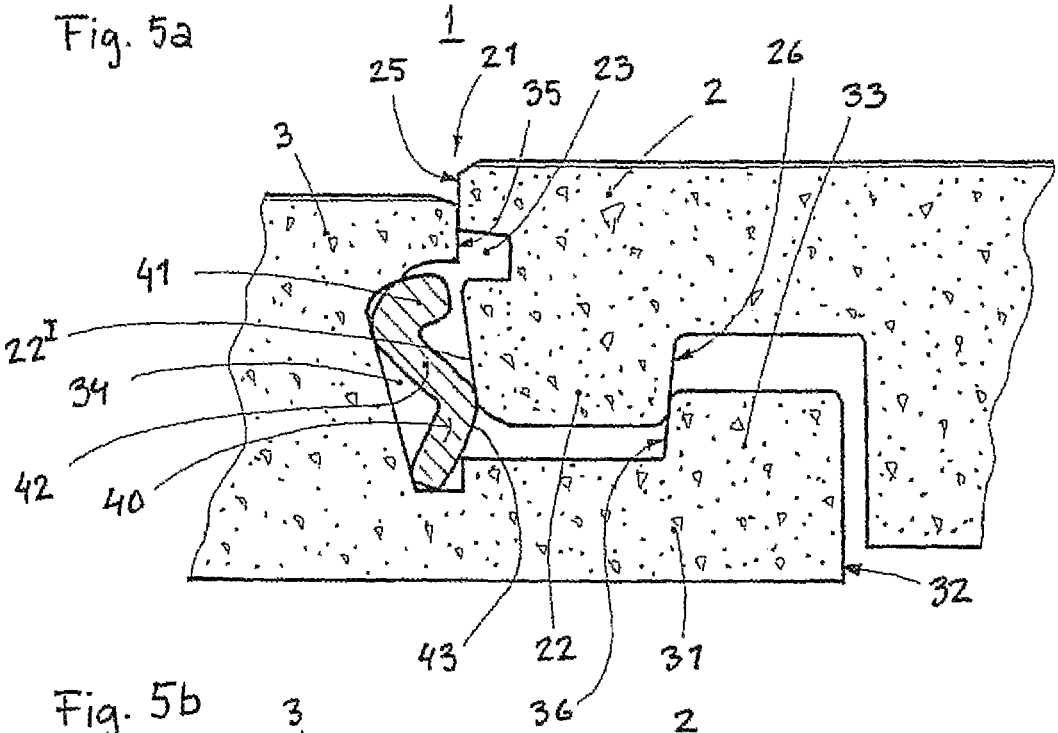
Figure 5B:
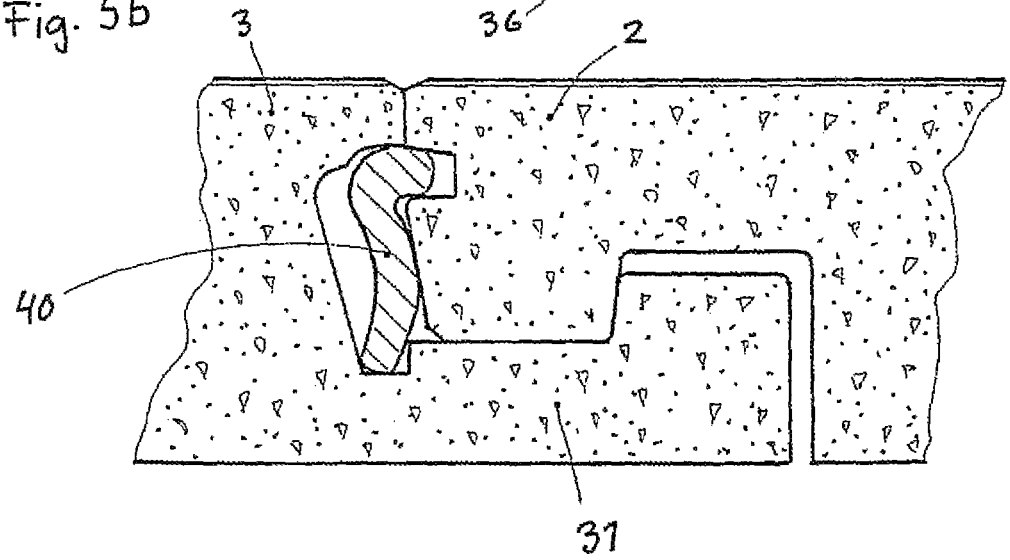

FIG. 5*a-b* shows in cross-section a joint 1 having a first edge 2 and a second edge 3 according to a fifth embodiment. FIG. 5*a* shows the joint 1 just before the joining and FIG. 5*b* shows the joint 1 after assembly. The fifth embodiment is an alternative embodiment. The first edge 2 is provided with a distal edge 21 and a downwards protruding heel 22. The distal edge 21 is further provided with an upper joint edge 25 beneath which a groove 23 is arranged. The second edge 3 is provided with a lower cheek 31 having a distal end 32 at which an upwards protruding lower cheek heel 33 is arranged. The second edge 3 is further provided with an upper joining edge 35 beneath which an undercut 34 is arranged. A moveable locking element 40 is arranged in the space created by the undercut 34. The moveable locking element 40 has a locking tongue 41, a locking tongue leg 42 and a maneuvering leg 43. The second edge 3 is intended to join with the first edge 2 through vertical motion.

Figure 6A:
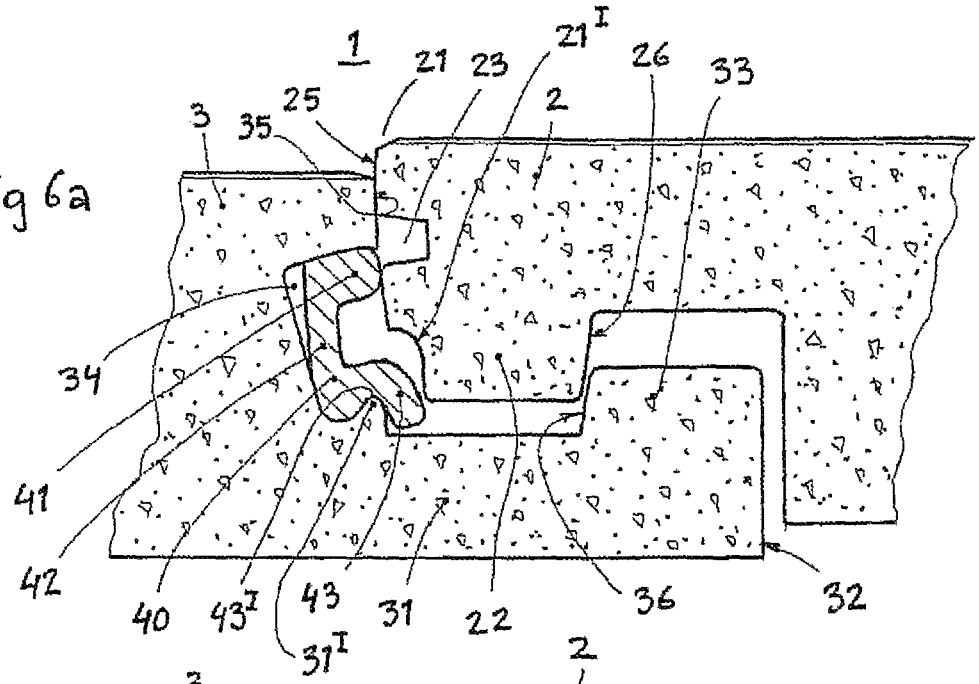
Figure 6B:
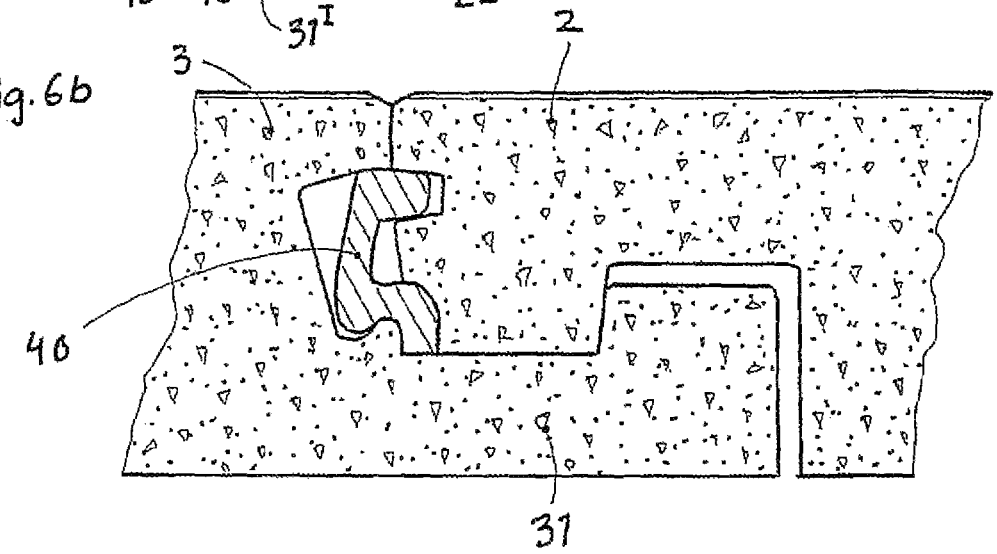
Figure 6C:
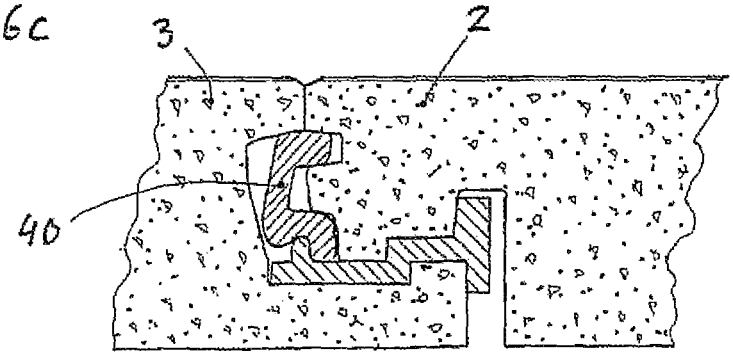

A front surface 22$^{I}$ of the downwards protruding heel 22 hereby presses on the maneuvering leg 43 urging the bent maneuvering leg 43 to straighten whereby the locking tongue 41 moves forward and engage the groove 23. The lower cheek heel 33 have a front face 36 while the downwards protruding heel 22 have a rear face 26. The front face 36 and the rear face 26 are intended to interact which results in the upper joint edge 25 and the upper joining edge 35 being urged together in an assembled joint FIG. 6*a-b* shows in cross-section a joint 1 having a first edge 2 and a second edge 3 according to a sixth. FIG. 6*a* shows the joint 1 just before the joining and FIG. 6*b* shows the joint 1 after assembly. FIG. 6*c* shows an alternative embodiment of the embodiment shown in FIG. 6*a-b*. Beginning with FIG. 6*a-b*, the first edge 2 is provided with a distal edge 21 and a downwards protruding heel 22. The distal edge 21 is further provided with an upper joint edge 25 beneath which a groove 23 is arranged. The second edge 3 is provided with a lower cheek 31 having a distal end 32 at which an upwards protruding lower cheek heel 33 is arranged. The second edge 3 is further provided with an upper joining edge 35 beneath which an undercut 34 is arranged. A moveable locking element 40 is arranged in the space created by the undercut 34. The moveable locking element 40 has a locking tongue 41, a locking tongue leg 42 and a maneuvering leg 43. The moveable locking element 40 is further provided with a pivot groove 43$^{I}$. The lower cheek 31 is provided with a pivot edge 31$^{I}$. The pivot groove 43 and the pivot edge 31$^{I}$ are intended to interact. The second edge 3 is intended to join with the first edge 2 through vertical motion.

A front surface 22$^{I}$ of the downwards protruding heel 22 hereby presses on the maneuvering leg 43 urging the maneuvering leg 43 to tilt with the pivot edge 31$^{I}$ as an axis of rotation whereby the locking tongue 41 moves forward and engage the groove 23. The lower cheek heel 33 have a front face 36 while the downwards protruding heel 22 have a rear face 26. The front face 36 and the rear face 26 are intended to interact which is resulting in the upper joint edge 25 and the upper joining edge 35 being urged together in an assembled joint 1. The lower cheek 31, the downwards protruding heal 22 and the maneuvering leg 43 are further designed so that the outermost portion of the maneuvering leg 43 is held in place by the downwards protruding heal 22 and the lower cheek 31 when the joint is assembled.

FIG. 6*c* mainly corresponds to FIG. 6*a-b* above. The upper portion of the lower cheek 31 containing lower cheek heal 33, front face 36 and pivot edge 31$^{I}$ is, however made of a separate material which is joined with the core material with for example glue. It is, however also possible to attach this portion by nailing, prizing or snapping it into position.

Figure 7A:
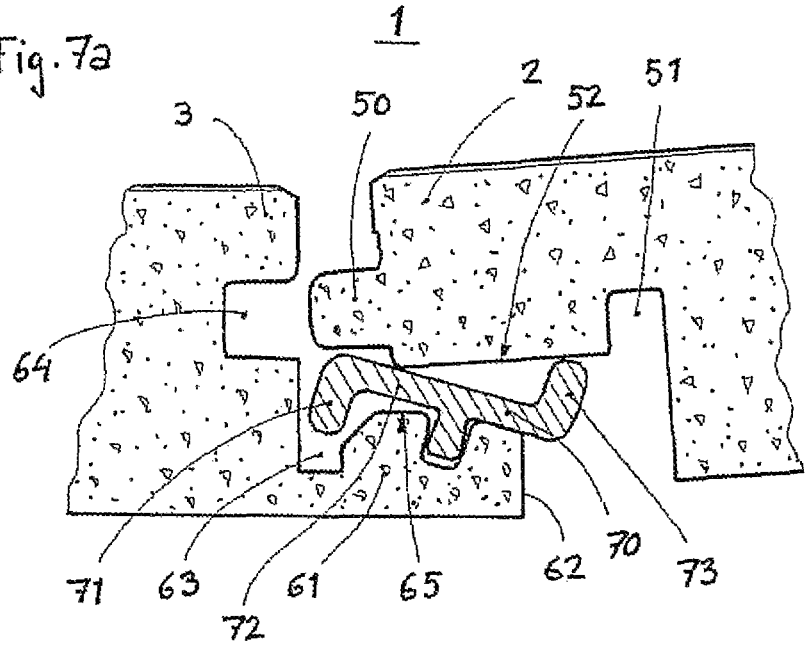
Figure 7B:
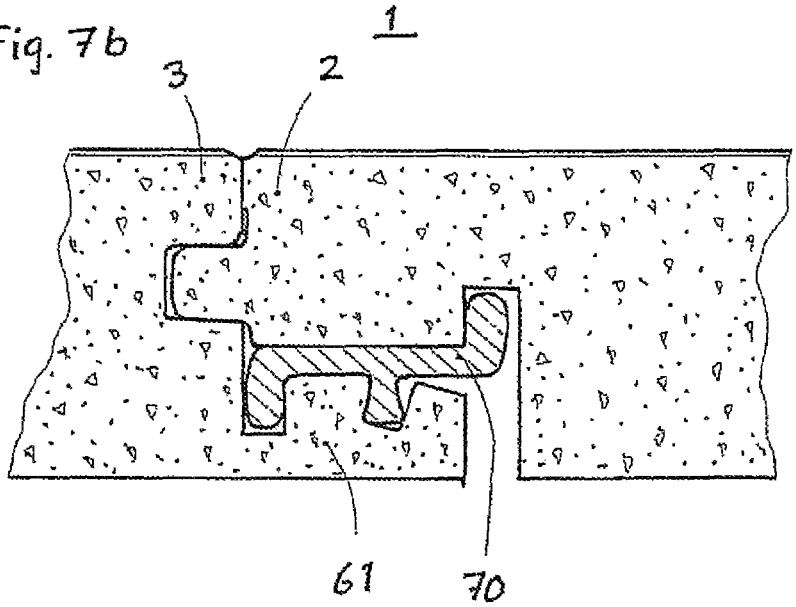

FIG. 7*a-b* shows in cross-section a joint 1 having a first edge 2 and a second edge 3 according to a seventh embodiment. FIG. 7*a* shows the joint 1 just before the joining and FIG. 7*b* shows the joint 1 after assembly. The seventh embodiment is an alternative embodiment where the joint is assembled through horizontal motion. The joint 1 have a first edge 2 and a second edge 3 wherein the first edge 2 is provided with a tongue 50 and a rear groove 51. The second edge 3 is provided with a lower cheek 61 having a distal end 62, an inner locking groove 63, a tongue groove 64 and a locking member surface 65. A moveable locking member 70 is arranged on the locking member surface 65. The moveable locking member 70 have an inner locking tongue 71, a maneuvering cheek 72 and an outer locking tongue 73. As said above the second edge 3 is intended to join with the first edge 2 through horizontal motion according to this, seventh embodiment. A maneuvering area 52 beneath the tongue 50 presses on the maneuvering cheek 72 urging the inner locking tongue 71 to move downwards and engage the inner locking groove 63. At the same time the outer locking tongue 72 will move upwards and engage the rear groove 51.

Figure 8A:
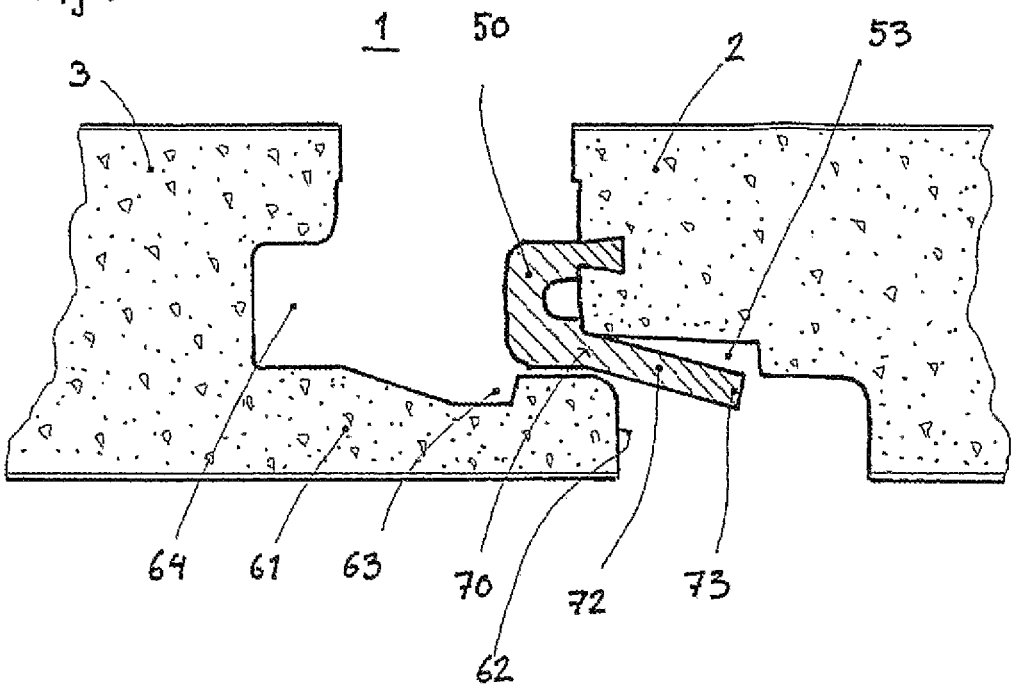
Figure 8B:
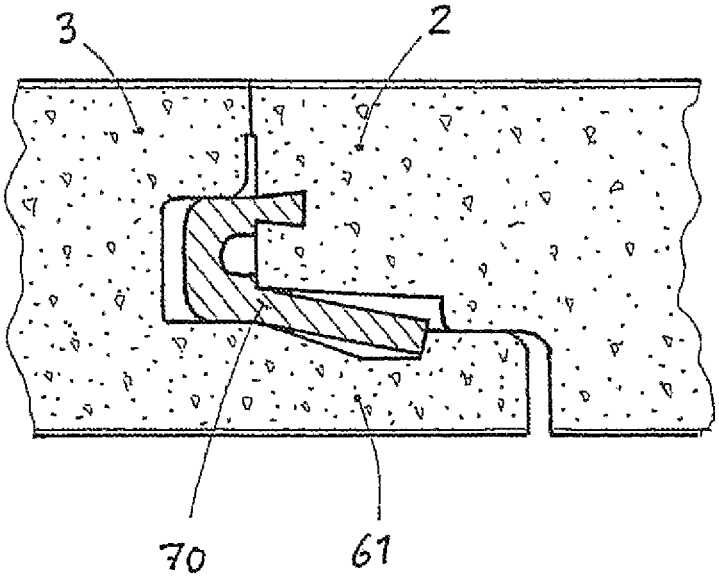

FIG. 8*a-b* shows in cross-section a joint 1 having a first edge 2 and a second edge 3 according to an eighth embodiment. FIG. 8*a* shows the joint 1 just before the joining and FIG. 8*b* shows the joint 1 after assembly. The eighth embodiment is an alternative embodiment where the joint is assembled through horizontal motion. The joint 1 have a first edge 2 and a second edge 3 wherein the first edge 2 is provided with a tongue 50 and a rear depression 53. The second edge 5 is provided with a lower cheek 61 having a distal end 62, an inner locking groove 63 and a tongue groove 64. A moveable locking member 70 is arranged on first edge 2. The moveable locking member 70 have a maneuvering cheek 72 and an outer locking tongue 73. As said above the second edge 3 is intended to join with the first edge 2 through horizontal motion according to this, eighth embodiment. The outer locking tongue 73 is urged upwards into the rear depression 53 during the assembly. It will then snap down into engagement with inner locking groove 63 once in the fully assembled position.

Figure 9:
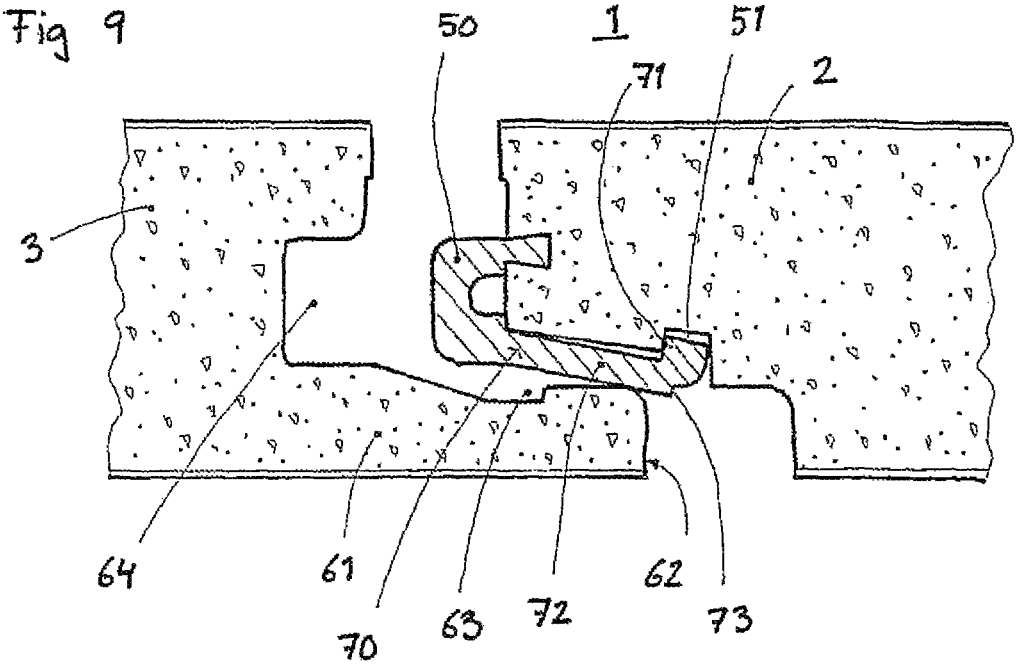

FIG. 9 shows in cross-section a joint 1 having a first edge 2 and a second edge 3 according to a ninth embodiment. FIG. 9 shows the joint 1 just before the joining. The ninth embodiment is an alternative embodiment where the joint is assembled through horizontal motion. The joint 1 have a first edge 2 and a second edge 3 wherein the first edge 2 is provided with a tongue 50 and a rear groove 51. The second edge 3 is provided with a lower cheek 61 having a distal end 62, an inner locking groove 63 and a tongue groove 64. A moveable locking member 70 is arranged on the first edge 2. The moveable locking member 70 have an inner locking tongue 71, a maneuvering cheek 72 and an outer locking tongue 73. As said above the second edge 3 is intended to join with the first edge 2 through horizontal motion according to this, ninth embodiment. The outer locking tongue 73 and the inner locking tongue 71 are urged upwards during the assembly. The outer locking tongue 73 will then snap down into engagement with inner locking groove 63 once in the fully assembled position.

Figure 10A:
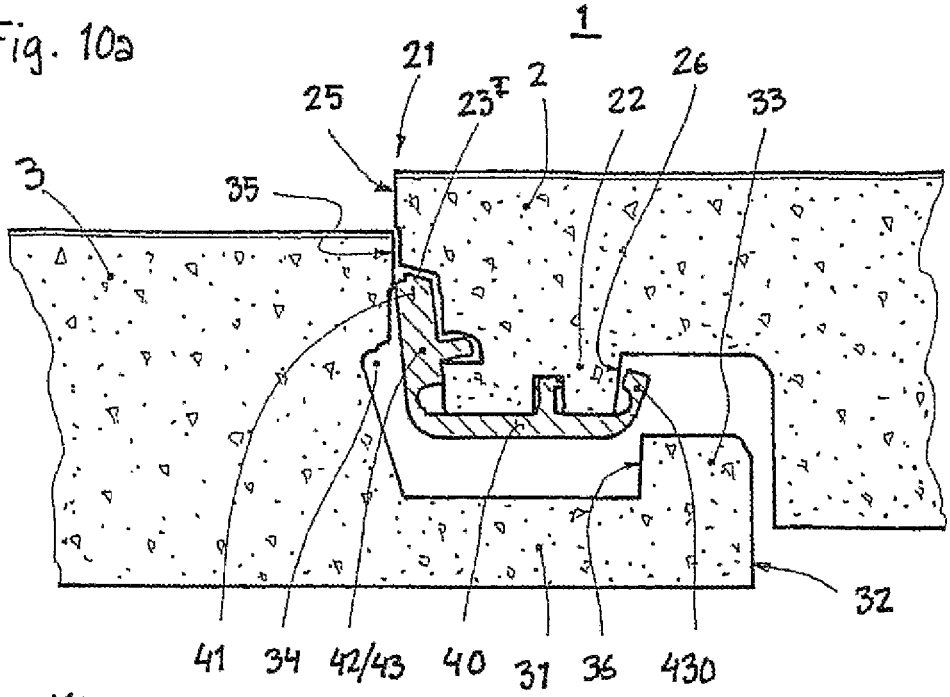
Figure 10B:
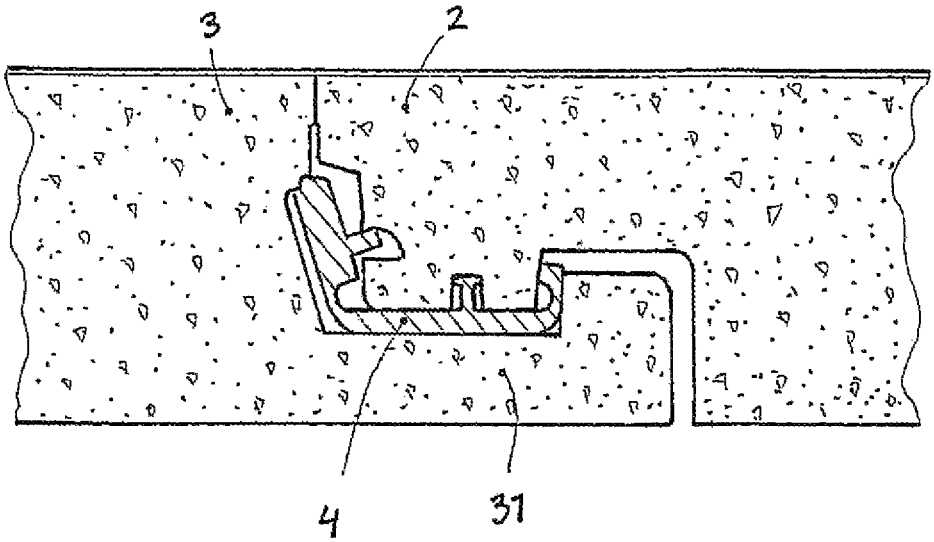

FIG. 10*a-b* shows in cross-section a joint 1 having a first edge 2 and a second edge 3 according to a tenth embodiment. FIG. 10*a* shows the joint 1 just before the joining and FIG. 10*b* shows the joint 1 after assembly. The first edge 2 is provided with a distal edge 21 and a downwards protruding heel 22. The distal edge 21 is further provided with an upper joint edge 25 beneath which an undercut space $\mathbf{23}^{I}$ is arranged. The second edge 3 is provided with a lower cheek 31 having a distal end 32 at which an upwards protruding lower cheek heel 33 is arranged. The second edge 3 is further provided with an upper joining edge 35 beneath which an undercut 34 is arranged. A moveable locking element 40 is arranged in the space created by the undercut space $\mathbf{23}^{I}$. The moveable locking element 40 has a locking tongue 41, a locking tongue leg 42 also acting as a maneuvering leg 43. The second edge 3 is intended to join with the first edge 2 through vertical motion. The lower cheek heel 33 have a front face 36 while the downwards protruding heel 22 have a rear face 26. The lower cheek heel 33 have a front face 36 while the downwards protruding heel 22 have a rear face 26 and the moveable locking element 40 have a face section 430. The front face 36 and the rear face 26 are intended to interact, having a face section 430 in an intermediate position. The interaction results in the upper joint edge 25 and the upper joining edge 35 being urged together in an assembled joint 1. The Socking tongue 41 will engage the undercut 34 when the edges 2 and 3 respectively are fully assembled.

DETAILED DESCRIPTION OF PREFERRED EMBODIMENT EXAMPLES

Figure 11:
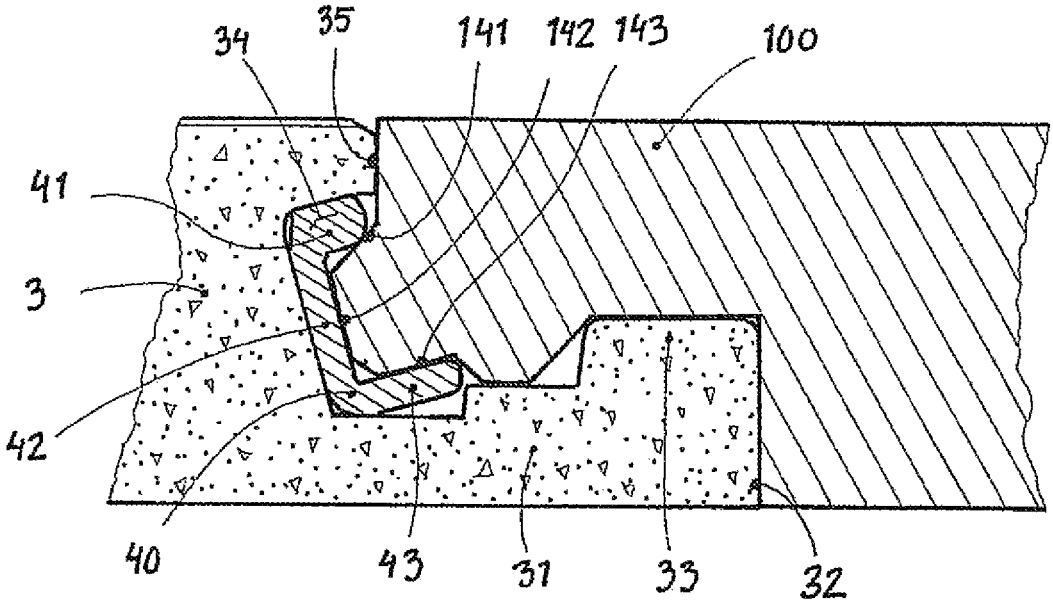
FIG. 11 shows a first embodiment of a joint guard 100 according to the invention.

FIG. 11 shows a first embodiment of a joint guard 100 according to the disclosure. An edge 3 as shown in FIG. 1*a-b* is provided with an upper joining edge 35 beneath which an undercut 34 is arranged. A moveable locking element 40 is arranged in the space created by the undercut 34. The moveable locking element 40 has a locking tongue 41, a locking tongue leg 42 and a maneuvering leg 43. The edge 3 is intended to join with a first edge 2 (see FIG. 1*a-b*) through vertical motion. A joint guard 100 is provided with means for protecting and stabilizing portions in the edge region of the panel. The portions protected and stabilized are: a lower cheek 31, a distal end 32, an upwards protruding lower cheek heel 33, an upper joining edge 35, an undercut 34, a moveable locking element 40, a locking tongue 41, a locking tongue leg 42 and a maneuvering leg 43. Accordingly, the joint guard 100 is provided with a locking tongue stopper 141, a locking tongue leg support 142 and a maneuvering leg support 143. The joint guard 100 is suitably made of medium density fiber board (MDF).

Figure 12:
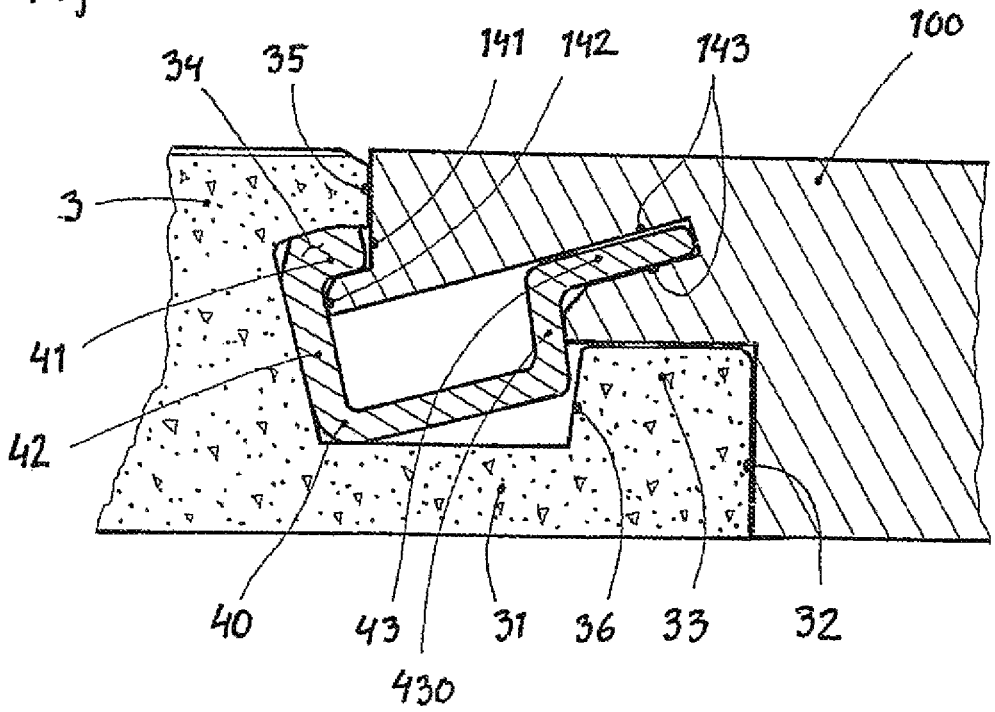
FIG. 12 shows a second embodiment of a joint guard 100 according to the invention.

FIG. 12 shows a second embodiment of a joint guard 100 according to the invention. An edge 3 as shown in FIG. 3*a-b* is provided with a lower cheek 31 having a distal end 32 at which an upwards protruding lower cheek heel 33 is arranged. The second edge 3 is further provided with an upper joining edge 35 beneath which an undercut 34 is arranged. A moveable locking element 40 is arranged in the space created by the undercut 34. The moveable locking element 40 has a locking tongue 41, a locking tongue leg 42 and a maneuvering leg 43. The second edge 3 is intended to join with the first edge 2 (see FIG. 3*a-b*) through vertical motion. The maneuvering leg 43 is here extended further to increase the locking force. The lower cheek heel 33 have a front face 36 and the maneuvering leg 43 have a face section 430. A joint guard 100 is provided with means for protecting and stabilizing portions in the edge region of the panel. The portions protected and stabilized are: a lower cheek 31, a distal end 32, an upwards protruding lower cheek heel 33, an upper joining edge 35, an undercut 34, a moveable locking element 40, a locking tongue 41, a locking tongue leg 42 and a maneuvering leg 43. Accordingly, the joint guard 100 is provided with a locking tongue stopper 141, a locking tongue leg support 142 and a maneuvering leg support 143, The joint guard 100 is suitably made of medium density fiber board (MDF).

Figure 13:
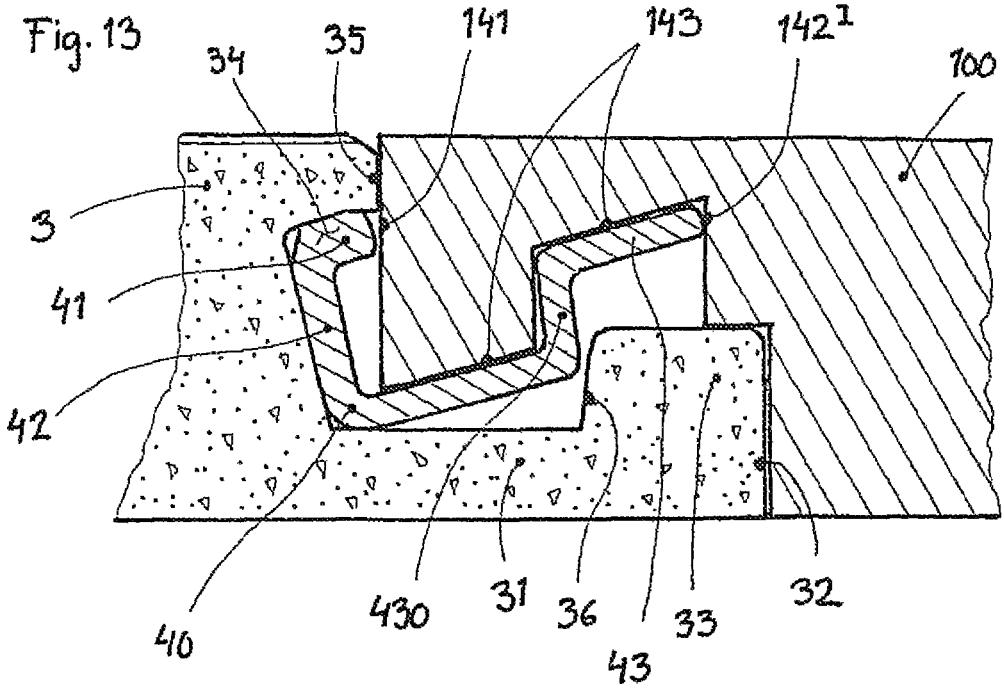
FIG. 13 shows a third embodiment of a joint guard 100 according to the invention.

FIG. 13 shows a third embodiment of a joint guard 100 according to the invention. An edge 3 as shown in FIG. 3*a-b* is provided with a lower cheek 31 having a distal end 32 at which an upwards protruding lower cheek heel 33 is arranged. The second edge 3 is further provided with an upper joining edge 35 beneath which an undercut 34 is arranged. A moveable locking element 40 is arranged in the space created by the undercut 34. The moveable locking element 40 has a locking tongue 41, a locking tongue leg 42 and a maneuvering leg 43. The second edge 3 is intended to join with the first edge 2 (see FIG. 3*a-b*) through vertical motion. The maneuvering leg 43 is here extended further to increase the locking force. The lower cheek heel 33 have a front face 36 and the maneuvering leg have a face section 430. A joint guard 100 is provided with means for protecting and stabilizing portions in the edge region of the panel. The portions protected and stabilized are: a lower cheek 31, a distal end 32, an upwards protruding lower cheek heel 33, an upper joining edge 35, an undercut 34, a moveable locking element 40, a locking tongue 41, a locking tongue leg 42 and a maneuvering leg 43. Accordingly, the joint guard 100 is provided with a locking-tongue stopper 141 and a maneuvering leg support 143. The distal edge of the maneuvering leg 43 is supported by a vertical surface 142$^{I}$. The joint guard 100 is suitably made of medium density fiber board (MDF).

Figure 14:
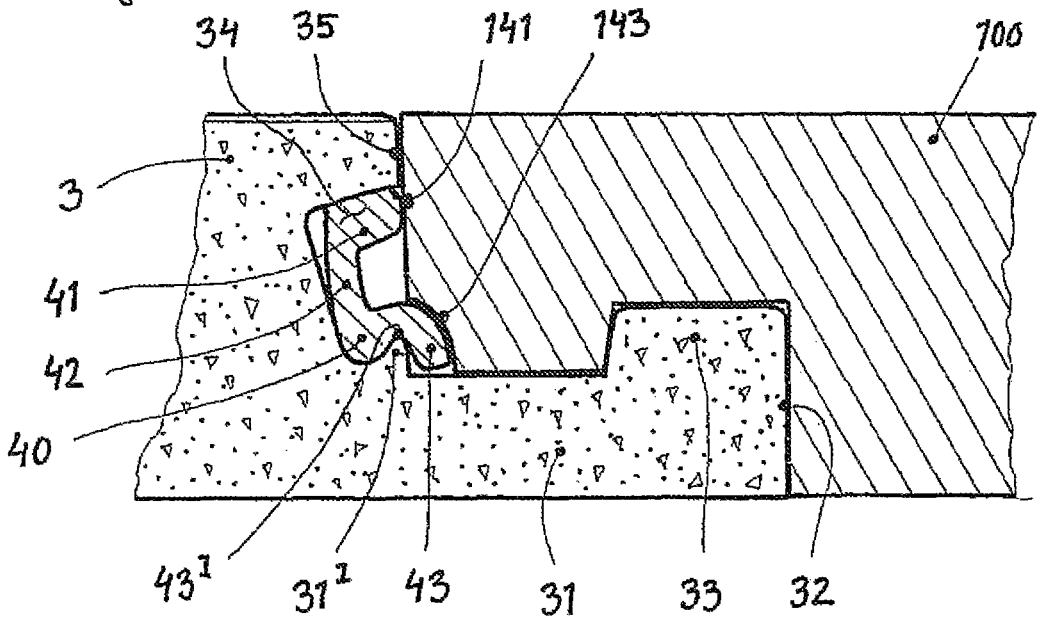
FIG. 14 shows a fourth embodiment of a joint guard 100 according to the invention.

FIG. 14 shows a fourth embodiment of a joint guard 100 according to the invention. An edge 3 as shown in FIG. 6*a-b* is provided with a lower cheek 31 having a distal end 32 at which an upwards protruding lower cheek heel 33 is arranged. The edge 3 is further provided with an upper joining edge 35 beneath which an undercut 34 is arranged. A moveable locking element 40 is arranged in the space created by the undercut 34. The moveable locking element 40 has a locking tongue 41, a locking tongue leg 42 and a maneuvering leg 43. The moveable locking element 40 is further provided with a pivot groove 43$^{I}$. The lower cheek 31 is provided with a pivot edge 31$^{I}$. The pivot groove 43$^{I}$ and the pivot edge 31$^{I}$ are intended to interact. The second edge 3 is intended to join with the first edge 2 (see FIG. 6*a-b*) through vertical motion. The lower cheek heel 33 has a front face 36. A joint guard 100 is provided with means for protecting and stabilizing portions in the edge region of the panel. The portions protected and stabilized are: a lower cheek 31, a distal end 32, an upwards protruding lower cheek heel 33, an upper joining edge 35, an undercut 34, a moveable locking element 40, a locking tongue 41, a locking tongue leg 42 and a maneuvering leg 43. Accordingly, the joint guard 100 is provided with a locking tongue stopper 141 and a maneuvering leg support 143. The joint guard 100 is suitably made of medium density fiber board (MDF).

Figure 15:
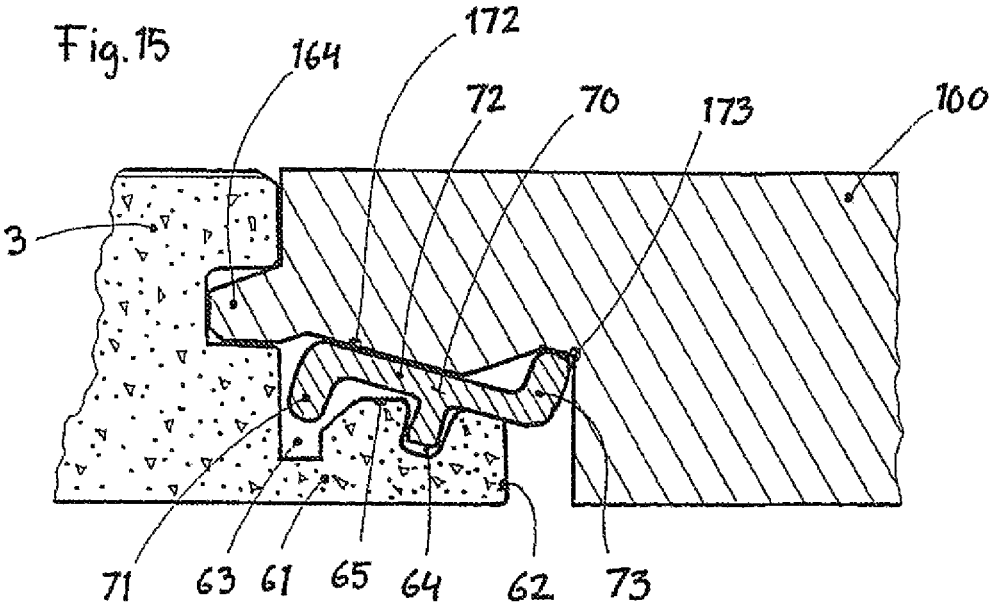
FIG. 15 shows a fifth embodiment of a joint guard 100 according to the invention.

FIG. 15 shows a fifth embodiment of a joint guard 100 according to the invention. A second edge 3 as shown in FIG. 7*a-b* is provided with a lower cheek 61 having a distal end 62, an inner locking groove 63, a tongue groove 64 and a locking member surface 65. A moveable locking member 70 is arranged on the locking member surface 65. The moveable locking member 70 have an inner locking tongue 71, a maneuvering cheek 72 and an outer locking tongue 73. The second edge 3 is intended to join with the first edge 2 (see FIG. 7*a-b*) through horizontal motion. A joint guard 100 is provided with means for protecting and stabilizing portions in the edge region of a panel. These portions are: a lower cheek 61, an inner locking groove 63, a tongue groove 64, a locking member surface 65, a moveable locking member 70, an inner locking tongue 71, a maneuvering cheek 72 and an outer locking tongue 73. The joint guard 100 supports, protect and stabilize through means of a maneuvering cheek support 172, an outer locking tongue support 173 and a groove engaging tongue 164. The joint guard 100 is suitably made of medium density fiber board (MDF).

Figure 16:
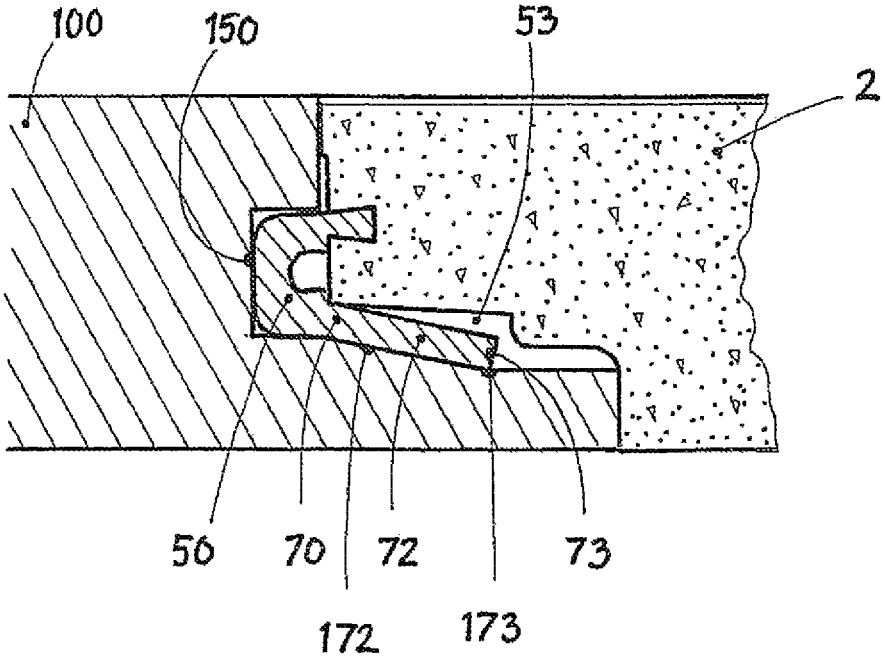
FIG. 16 shows a sixth embodiment of a joint guard 100 according to the invention.

FIG. 16 shows a sixth embodiment of a joint guard 100 according to the invention. A first edge 2 as shown in FIG. 8*a-b* is provided with a tongue 50 and a rear depression 53. A moveable locking member 70 is arranged on first edge 2. The moveable locking member 70 have a maneuvering cheek 72 and an outer locking tongue 73. A second edge 3 (see FIG. 8*a-b*) is intended to join with the first edge 2 through horizontal motion. The outer locking tongue 73 is urged upwards into the rear depression 53 during the assembly. It will then snap down into engagement with inner locking groove 63 (see FIG. 8*a-b*) once in the fully assembled position. A joint guard 100 is provided with means for protecting and stabilizing portions in the edge region of a panel. These portions are: a moveable locking member 70, a maneuvering cheek 72, an outer locking tongue 73 and a tongue 50. The joint guard 100 supports, protects and stabilizes through a maneuvering cheek support 172, an outer locking tongue support 173 and a tongue engaging groove 150. Also the vertical edge portions of the joint are protected. The joint guard 100 is suitably made of medium density fiber board (MDF).

Figure 17:
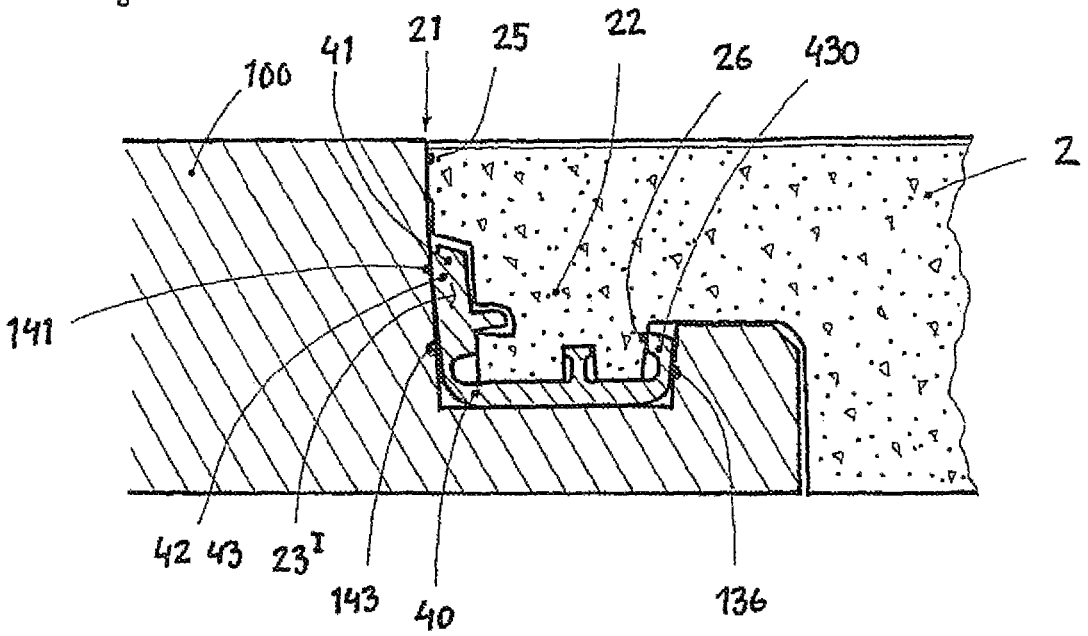
FIG. 17 shows a seventh embodiment of a joint guard 100 according to the invention.

FIG. 17 shows a seventh embodiment of a joint guard 100 according to the invention. A first edge 2 as shown in FIG. 10*a-b* is provided with a distal edge 21 and a downwards protruding heel 22. The distal edge 21 is further provided with an upper joint edge 25 beneath which an undercut space 23$^{I}$ is arranged. A moveable locking element 40 is arranged in the space created by the undercut space 23$^{I}$. The moveable locking element 40 has a locking tongue 41, a locking tongue leg 42 also acting as a maneuvering leg 43. The second edge 3 (see FIG. 10*a-b*) is intended to join with the first edge 2 through vertical motion. The downwards protruding heel 22 have a rear face 26 and the moveable locking element 40 have a face section 430. A joint guard 100 is provided with means for protecting and stabilizing portions in the edge region of the panel. The portions protected and stabilized are: a distal edge 21, a downwards protruding heel 22, an upper joint edge 25, an undercut space 23$^{I}$, a rear face 26, a moveable locking element 40, a locking tongue 41, a locking tongue leg 42 and a maneuvering leg 43 and a face section 430. Accordingly, the joint guard 100 is provided with a locking tongue stopper 141, a maneuvering leg support 143 and a face section support 136. The joint guard 100 is suitably made of medium density fiber board (MDF).

Figure 18:
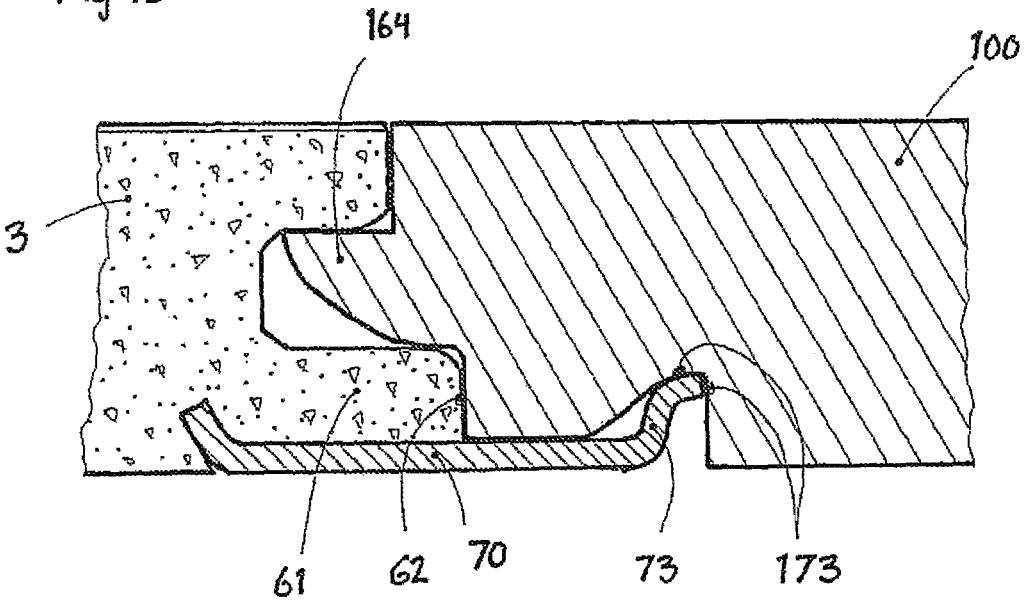
FIG. 18 shows a eighth embodiment of a joint guard 100 according to the invention.

FIG. 18 shows a eighth embodiment of a joint guard 100 according to the invention. A second edge 3 known through WO 94/26999 is provided with a lower cheek 61 having a distal end 62. A bendable locking member 70 is arranged on a second edge 3. The bendable locking member 70 has an outer locking tongue 73. A joint guard 100 is provided with means for protecting and stabilizing portions in the edge region of a panel. These portions are: a lower cheek 61, a distal end 62, a bendable locking member 70 and an outer locking tongue 73. The joint guard 100 support, protect and stabilize through means of an outer locking tongue support 173 and a groove engaging tongue 164. The basic principle of the joint guard 100 shown in FIG. 18 is also applicable on joints as described in WO 03/083234. The joint guard 100 is suitably made of medium density fiber board (MDF).

Figure 19:
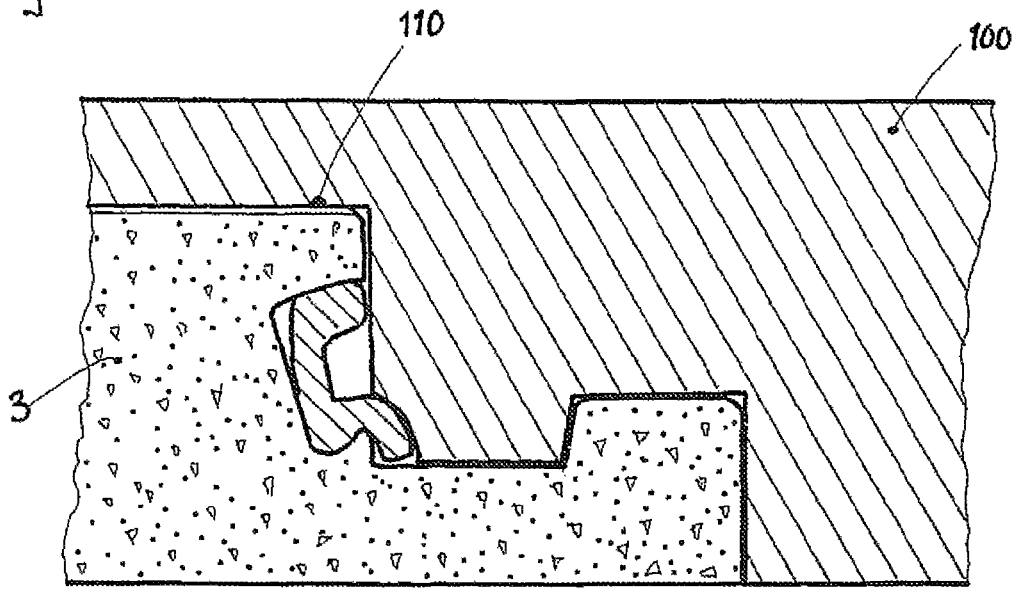
FIG. 19 shows a variation of the fourth embodiment, shown in FIG. 14, of a joint guard 100 according to the invention.

FIG. 19 shows a variation of the fourth embodiment, shown in FIG. 14, of a joint guard 100 according to the invention. The joint guard 100 is provided with a locking tongue stopper 141 and a maneuvering leg support 143 as described in FIG. 14. The joint guard 100 according to the alternative embodiment shown in FIG. 19 is further provided with an top surface edge guard 110 intended protect the edge of a top surface laminate during cutting, especially from splitting and separating in the edge region.

Figure 20:
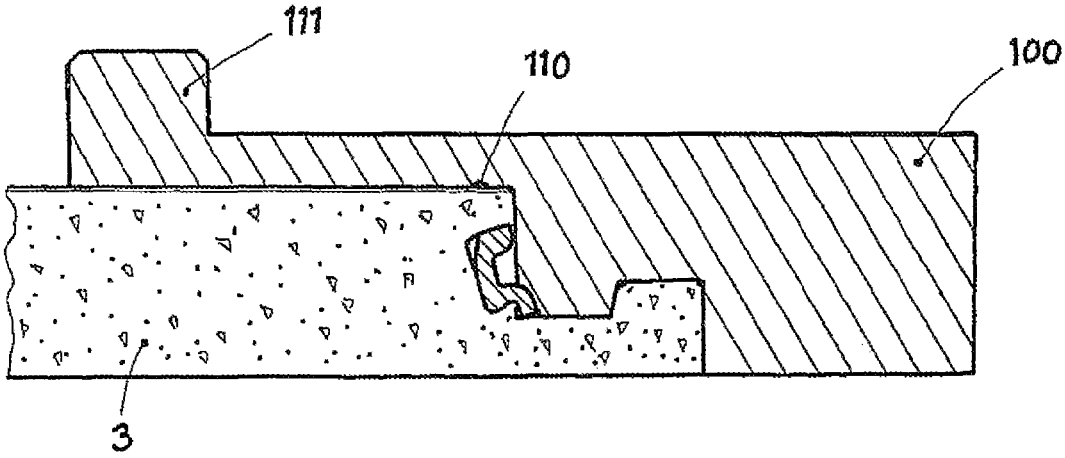
FIG. 20 shows another variation of the fourth embodiment, shown in FIG. 14, of a joint guard 100 according to the invention.

FIG. 20 shows another variation of the fourth embodiment, shown in FIG. 14, of a joint guard 100 according to the invention. Above what is described in figure connection to 14 and 19 the joint guard is further provided with a handle 111 used for holding the joint guard 100 in place during for example cutting. The handle 111 is especially useful when using the joint guard 100 as a tapping block.

Figure 21:
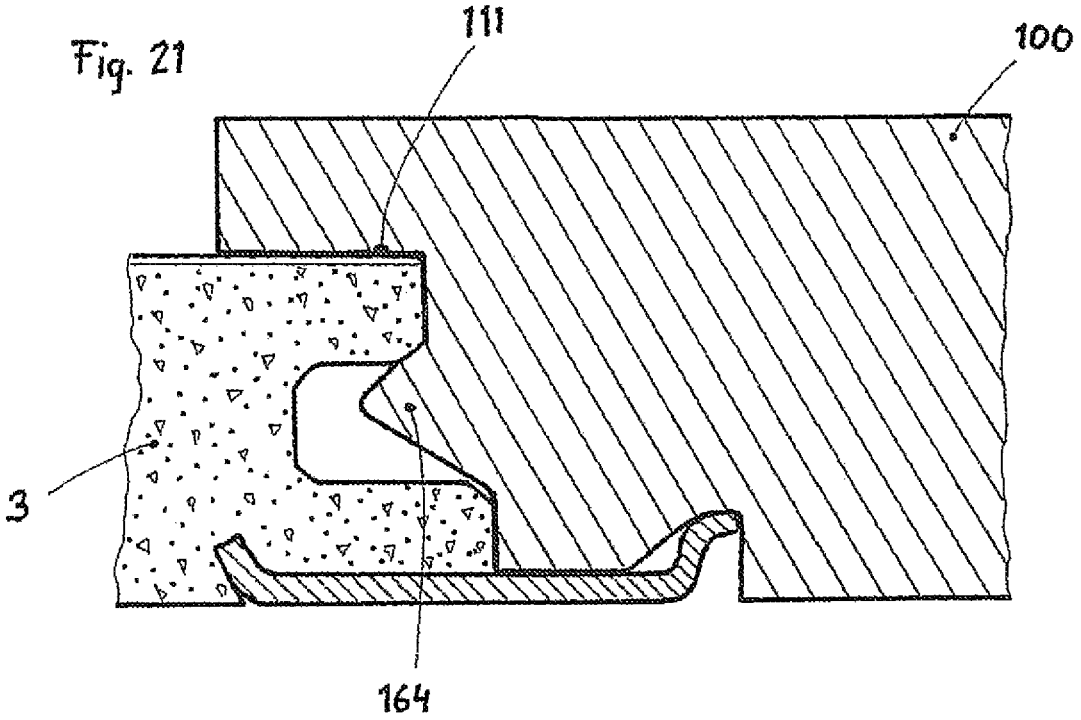
FIG. 21 shows a variation of the eighth embodiment, shown in FIG. 18, of a joint guard 100 according to the invention.

FIG. 21 shows a variation of the eighth embodiment, shown in FIG. 18, of a joint guard 100 according to the invention. The joint guard 100 supports, protect and stabilize through means of an outer locking tongue support 173 and a groove engaging tongue 164. The joint guard 100 according to the alternative embodiment shown in FIG. 21 is further provided with a top surface edge guard 110 intended protect the edge of a top surface laminate during cutting, especially from splitting and separating in the edge region. The groove engaging tongue 164 is also made more shallow and tapered compared to the embodiment shown in FIG. 18.

Figure 22:
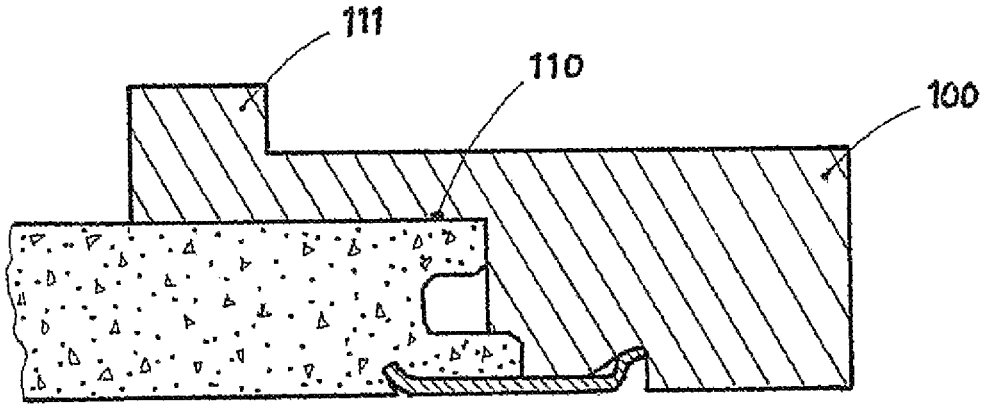
FIG. 22 shows another variation of the eighth embodiment, shown in FIG. 18, of a joint guard 100 according to the invention.

FIG. 22 shows another variation of the eighth embodiment, shown in FIG. 18, of a joint guard 100 according to the invention. Above what is described in connection to FIGS. 18 and 21 the joint guard is further provided with a handle 111 used for holding the joint guard 100 in place during for example cutting. The handle 111 is especially useful when using the joint guard 100 as a tapping block. The groove engaging tongue 164 of FIGS. 18 and 21 is furthermore omitted in the embodiment shown in FIG. 22.

The invention is not limited by the embodiments shown as they can be varied in different ways within the scope of the invention.

What is claimed is:

1. A system comprising a floor panel and a joint guard, wherein the floor panel comprises:

at least one pair of opposite edges, the pair of opposite edges comprising a first edge provided with a distal edge and a downwards protruding heel, and a second edge provided with a lower cheek having a distal end at which an upwards protruding lower cheek heel is arranged, wherein the first edge is configured to join with a corresponding second edge of another floor panel through a substantially rectilinear downward motion; wherein a moveable locking element is disposed in an undercut space arranged at the first or second edge; and wherein the joint guard is a provision for protecting and stabilizing a portion in an edge region of the floor panel, the portion at least including part of the moveable locking element, the joint guard being configured to hold the moveable locking element in an inactive position, whereby the moveable locking element is prevented from being actuated by lateral contact along the pair of opposite edges, wherein the moveable locking element is in an active locking position when the joint guard is de-activated and the floor panel is joined to another floor panel.

2. The system of claim 1, wherein the moveable locking element has at least a locking tongue, wherein the portion protected and stabilized includes at least the locking tongue, wherein the distal edge of the first edge is provided with an upper joint edge beneath which a groove is arranged, wherein the second edge is provided with an upper joining edge beneath which an undercut is arranged, wherein the moveable locking element is arranged in the space created by the undercut, and wherein the locking tongue is configured to engage the groove of a corresponding first edge of another floor panel.

3. The system of claim 2, wherein the locking tongue is in a retracted position in the inactive position.

4. The system of claim 3, wherein the locking tongue comprises an upper locking surface that is located in the space created by the undercut in the retracted position.

5. The system of claim 4, wherein the upper locking surface does not extend beyond the upper joining edge of the second edge in distal direction with respect to the second edge in the retracted position.

6. The system of claim 2, wherein the upper locking surface is longer than the portion of the locking tongue that can engage the groove.

7. The system of claim 2, wherein the moveable locking element further comprises a locking tongue leg and a maneuvering leg.

8. The system of claim 1, wherein the moveable locking element has at least a locking tongue, wherein the portion protected and stabilized includes at least the locking tongue, wherein the distal edge of the first edge is provided with an upper joint edge beneath which an undercut space is arranged, wherein the second edge has an upper joining edge beneath which an undercut is arranged, wherein the moveable locking element is arranged in the space created by the undercut space, and wherein the locking tongue is configured to engage the undercut of a corresponding second edge of another floor panel.

9. The system of claim 8, wherein the locking tongue is in a retracted position in the inactive position.

10. The system of claim 9, wherein the locking tongue comprises an upper locking surface that is located in the undercut space in the retracted position.

11. The system of claim 10, wherein the upper locking surface does not extend beyond the upper joint edge of the first edge in distal direction with respect to the first edge in the retracted position.

12. The system of claim 8, wherein the upper locking surface is longer than the portion of the locking tongue that can engage the undercut.

13. The system of claim 8, wherein the moveable locking element further comprises a locking tongue leg and a maneuvering leg.

14. The system of claim 1, wherein the moveable locking element is made through extrusion molding.

15. The system of claim 1, wherein the moveable locking element is made of a thermoplastic material, a thermosetting material or a metal.

16. The system of claim 1, wherein the moveable locking element is made of a composite material.

* * * * *